US010381700B2

(12) United States Patent
Ashida et al.

(10) Patent No.: US 10,381,700 B2
(45) Date of Patent: Aug. 13, 2019

(54) DIELECTRIC FILTER

(71) Applicant: TDK CORPORATION, Tokyo (JP)

(72) Inventors: Yuta Ashida, Tokyo (JP); Kazunari Kimura, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 13 days.

(21) Appl. No.: 15/620,053

(22) Filed: Jun. 12, 2017

(65) Prior Publication Data

US 2017/0365902 A1 Dec. 21, 2017

(30) Foreign Application Priority Data

Jun. 17, 2016 (JP) ..... 2016-121046

(51) Int. Cl.

| | |
|---|---|
| ***H01P 1/20*** | (2006.01) |
| ***H01P 7/10*** | (2006.01) |
| ***H01P 1/203*** | (2006.01) |
| ***H01P 1/208*** | (2006.01) |

(52) U.S. Cl.

CPC ..... *H01P 1/2002* (2013.01); *H01P 1/2084* (2013.01); *H01P 1/20309* (2013.01); *H01P 7/10* (2013.01)

(58) Field of Classification Search

CPC ..... H01P 7/10; H01P 1/2084; H01P 1/208; H01P 1/20309; H01P 1/2002

USPC ..... 333/202, 203, 206

See application file for complete search history.

(56) References Cited

FOREIGN PATENT DOCUMENTS

| | | | |
|---|---|---|---|
| CN | 103855448 | A | 6/2014 |
| JP | H05-304401 | A | 11/1993 |
| JP | H11-355005 | A | 12/1999 |
| JP | 2006-238027 | A | 9/2006 |
| JP | 2016-010018 | A | 1/2016 |

OTHER PUBLICATIONS

Dec. 29, 2018 Office Action issued in Chinese Patent Application No. 201710456888.3.

*Primary Examiner* — Rakesh B Patel
(74) *Attorney, Agent, or Firm* — Oliff PLC

(57) ABSTRACT

A dielectric filter includes: a resonator body formed of dielectric material; surrounding dielectric portion present around the resonator body and formed of dielectric material having a relative permittivity lower than the dielectric material used to form the resonator body; and an input/output conductor portion formed of a conductor and configured to perform at least one supply of an electromagnetic wave to the resonator body and reception of an electromagnetic wave from the resonator body. The resonator body has a first end face and a second end face located at opposite ends in a first direction. The input/output conductor portion is located either at least part of the input/output conductor portion is contained in a space formed by shifting a virtual plane corresponding to the first end face in the first direction away from the second end face, or the input/output conductor portion is in contact with the space.

14 Claims, 12 Drawing Sheets

DIELECTRIC FILTER

BACKGROUND OF THE INVENTION

1. Field of the Invention

The present invention relates to a dielectric filter including a dielectric resonator.

2. Description of the Related Art

The standardization of fifth-generation mobile communication systems (hereinafter referred to as 5G) is currently ongoing. For 5G, the use of frequency bands of 10 GHz or higher, particularly millimeter wavebands of 30 to 300 GHz, is being studied to expand the frequency band.

Among electronic components for use in communication devices are filters including resonators, such as band-pass filters. Dielectric filters including dielectric resonators are promising as filters usable in the frequency bands of 10 GHz or higher.

In general, a dielectric filter includes: a resonator body formed of a dielectric material; a surrounding dielectric portion formed of a dielectric material having a relative permittivity lower than that of the dielectric material used to form the resonator body; and an input/output conductor portion. The surrounding dielectric portion is present around the resonator body. The input/output conductor portion is used for at least one of supply of an electromagnetic wave to the resonator body and reception of an electromagnetic wave from the resonator body. Such a dielectric filter is described in, for example, JP 2006-238027A, JP H11-355005A, and JP H5-304401A.

JP 2006-238027A describes a dielectric filter including a dielectric substrate, a plurality of dielectric resonators embedded in the dielectric substrate, an input portion, and an output portion. Each of the dielectric resonators of this dielectric filter is in a cylindrical shape. The dielectric resonators are arranged with a predetermined spacing between adjacent ones along the direction of signal transmission in such a posture that the direction of axis of each dielectric resonator is perpendicular to the direction of signal transmission. The input portion and the output portion are provided inside the dielectric substrate, and drawn out to the external surfaces of the dielectric substrate. The input portion is located near one of the dielectric resonators so as to be aligned with this dielectric resonator in the direction of signal transmission. The output portion is located near another one of the dielectric resonators so as to be aligned with this dielectric resonator in the direction of signal transmission. The dielectric resonators and the dielectric substrate in JP 2006-238027A respectively correspond to the resonator body and the surrounding dielectric portion mentioned above. Both of the input portion and the output portion in JP 2006-238027A correspond to the input/output conductor portion mentioned above.

JP H11-355005A describes a filter including two dielectric substrates, a plurality of dielectric resonators, two microstrip lines, and a grounded conductor. In this filter, the two dielectric substrates are disposed on the top and bottom of the grounded conductor to sandwich the grounded conductor. In the dielectric substrate on the top side, a plurality of holes are formed to open at the top surface of the dielectric substrate. The dielectric resonators are embedded into the holes. The two microstrip lines are formed on the top surface of the dielectric substrate on the top side. One of the microstrip lines is located near one of the dielectric resonators. The other of the microstrip lines is located near another one of the dielectric resonators. In the dielectric substrate on the top side, there are formed a plurality of voids each of which is situated between the dielectric resonator and the grounded conductor. The dielectric resonators and the dielectric substrates in JP H11-355005A respectively correspond to the resonator body and the surrounding dielectric portion mentioned above. Both of the two microstrip lines in JP H11-355005A correspond to the input/output conductor portion mentioned above.

JP H5-304401A describes a dielectric filter including two dielectric resonators, a resin embedding the two dielectric resonators, thin-film electrodes covering the resin, and two input/output pins. The dielectric resonators and the resin in JP H5-304401A respectively correspond to the resonator body and the surrounding dielectric portion mentioned above. Both of the two input/output pins in JP H5-304401A correspond to the input/output conductor portion mentioned above.

In mobile communications, traffic has been increasing in recent years. To deal with this problem, the allocation of wide useful frequency bands is important, as well as an increase in communication speed. When wide useful frequency bands are allocated to communication systems such as 5G in frequency bands of 10 GHz or higher, filters having large fractional bandwidths are required as filters to be used in the communication systems.

However, increasing fractional bandwidths is difficult for conventional dielectric filters.

SUMMARY OF THE INVENTION

It is an object of the present invention to provide a dielectric filter having an increased fractional bandwidth.

A dielectric filter of a first aspect of the present invention includes: a resonator body formed of a dielectric material; a surrounding dielectric portion present around the resonator body and formed of a dielectric material having a relative permittivity lower than that of the dielectric material used to form the resonator body; and an input/output conductor portion formed of a conductor and configured to perform at least one of supply of an electromagnetic wave to the resonator body and reception of an electromagnetic wave from the resonator body.

A dimension of the resonator body in a first direction is greater than a maximum dimension of the resonator body in a direction orthogonal to the first direction. The resonator body has a first end face and a second end face located at opposite ends in the first direction. The input/output conductor portion is located either such that at least part of the input/output conductor portion is contained in a space that is formed by shifting a virtual plane corresponding to the first end face in the first direction away from the second end face, or such that the input/output conductor portion is in contact with the space.

In the dielectric filter of the first aspect of the invention, any cross section of the resonator body that is orthogonal to the first direction may have a constant shape irrespective of the distance between the cross section and the first end face.

In the dielectric filter of the first aspect of the invention, the input/output conductor portion may be located such that the entirety of the input/output conductor portion is contained in the space.

In the dielectric filter of the first aspect of the invention, the input/output conductor portion may have a third end face and a fourth end face located at opposite ends in the first direction. The third end face is located closer to the first end face of the resonator body than is the fourth end face. The input/output conductor portion may have a shape having three-fold or higher rotational symmetry about an axis parallel to the first direction. The input/output conductor portion may be embedded in the surrounding dielectric portion such that the fourth end face is exposed on an external surface of the surrounding dielectric portion. A dimension of the input/output conductor portion in the first direction may be in the range of 0.2 to 1 times the distance between the first end face and a virtual plane that includes the fourth end face and is parallel to the first end face. The dimension of the input/output conductor portion in the first direction may be greater than a maximum dimension of the input/output conductor portion in a direction orthogonal to the first direction.

The dielectric filter of the first aspect of the invention may further include a shield conductor portion formed of a conductor. The shield conductor portion is located around the resonator body such that at least part of the surrounding dielectric portion is interposed between at least part of the resonator body and the shield conductor portion.

A dielectric filter of a second aspect of the invention includes: a plurality of resonator bodies each formed of a dielectric material; a surrounding dielectric portion present around the plurality of resonator bodies and formed of a dielectric material having a relative permittivity lower than that of the dielectric material used to form the plurality of resonator bodies; and a first input/output conductor portion and a second input/output conductor portion each formed of a conductor.

Of the plurality of resonator bodies, every two resonator bodies that are adjacent to each other in circuit configuration are configured to be electromagnetically coupled to each other. The plurality of resonator bodies include a first input/output stage resonator body and a second input/output stage resonator body. The first input/output conductor portion is configured to perform at least one of supply of an electromagnetic wave to the first input/output stage resonator body and reception of an electromagnetic wave from the first input/output stage resonator body. The second input/output conductor portion is configured to perform at least one of supply of an electromagnetic wave to the second input/output stage resonator body and reception of an electromagnetic wave from the second input/output stage resonator body.

Respective dimensions of the first and second input/output stage resonator bodies in the first direction are greater than respective maximum dimensions of the first and second input/output stage resonator bodies in a direction orthogonal to the first direction. Each of the first and second input/output stage resonator bodies has a first end face and a second end face located at opposite ends in the first direction.

The first input/output conductor portion is located either such that at least part of the first input/output conductor portion is contained in a first space that is formed by shifting a virtual plane corresponding to the first end face of the first input/output stage resonator body in the first direction away from the second end face of the first input/output stage resonator body, or such that the first input/output conductor portion is in contact with the first space.

The second input/output conductor portion is located either such that at least part of the second input/output conductor portion is contained in a second space that is formed by shifting a virtual plane corresponding to the first end face of the second input/output stage resonator body in the first direction away from the second end face of the second input/output stage resonator body, or such that the second input/output conductor portion is in contact with the second space.

The dielectric filters of the first and second aspects of the invention allow a reduction in external Q, which depends on the strength of electromagnetic coupling between the input/output conductor portion and the resonator body, thus resulting in an increase in the fractional bandwidths of the dielectric filters.

Other and further objects, features and advantages of the invention will appear more fully from the following description.

DETAILED DESCRIPTION OF THE PREFERRED EMBODIMENT

Figure 1:
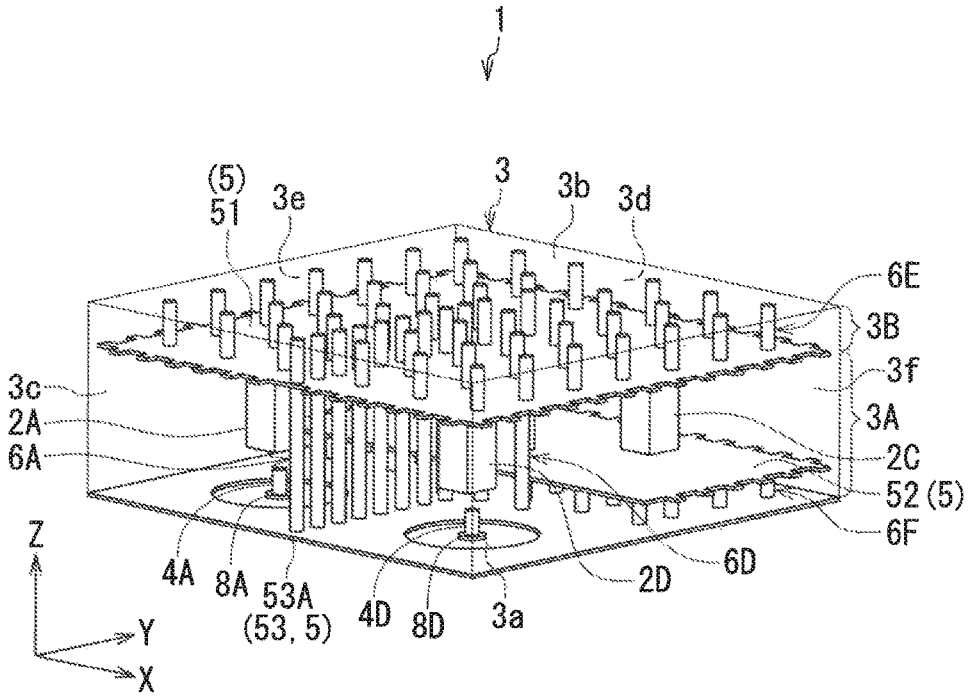
FIG. 1 is an internal perspective view of a dielectric filter according to an embodiment of the invention.
Figure 2:
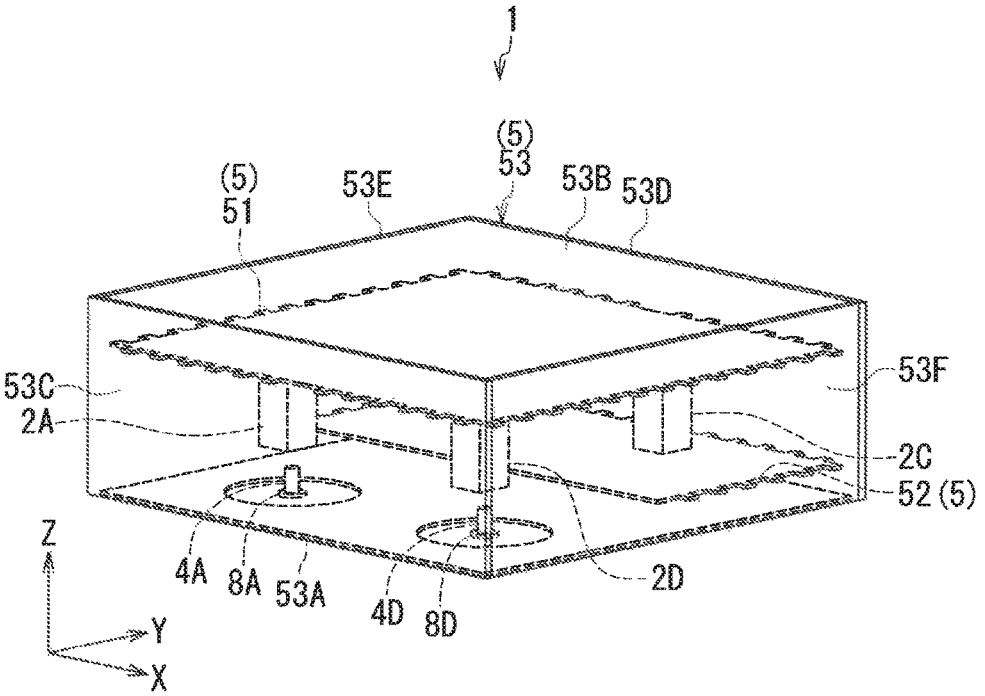
FIG. 2 is an external perspective view of the dielectric filter according to the embodiment of the invention.
Figure 3:
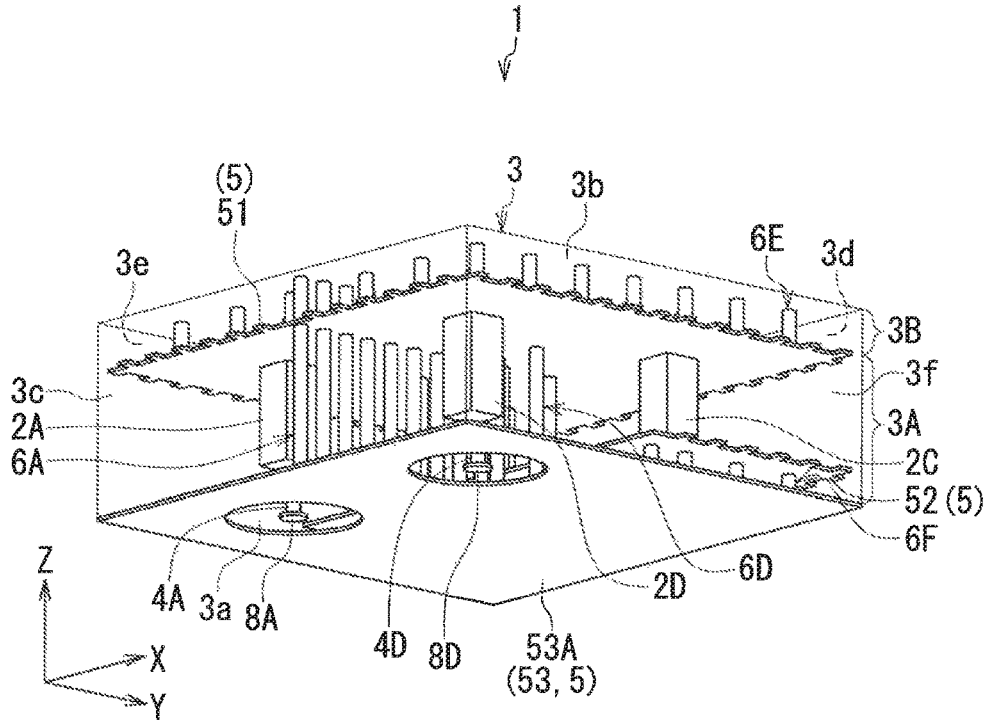
FIG. 3 is an internal perspective view of the dielectric filter according to the embodiment of the invention.
Figure 4:
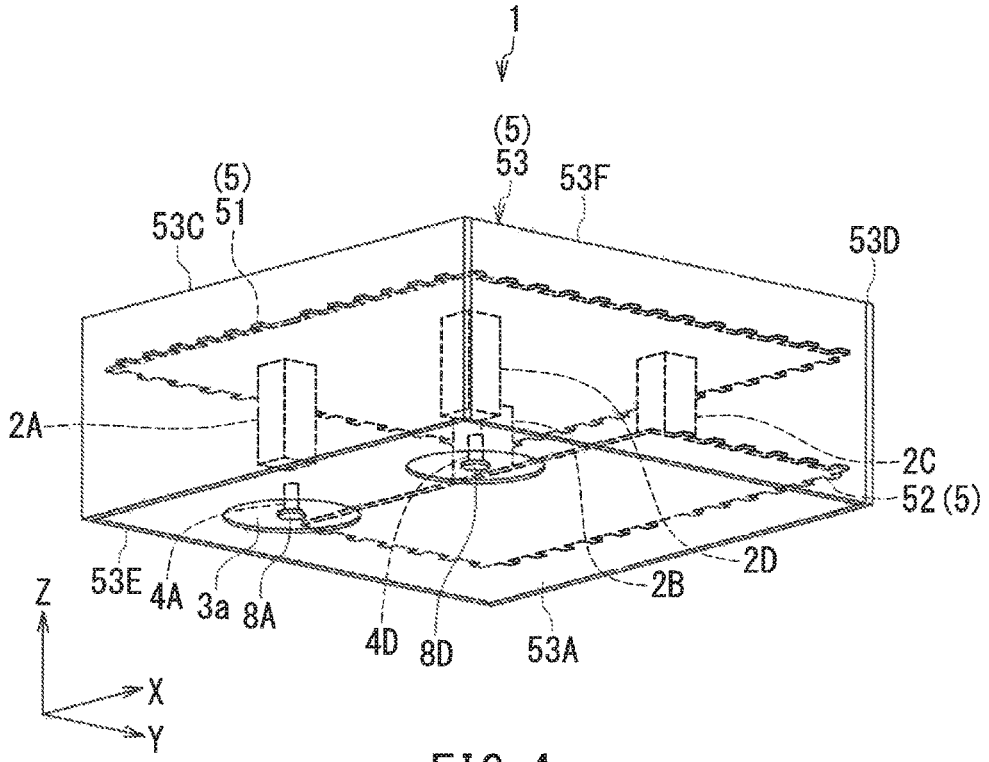
FIG. 4 is an external perspective view of the dielectric filter according to the embodiment of the invention.
Figure 5:
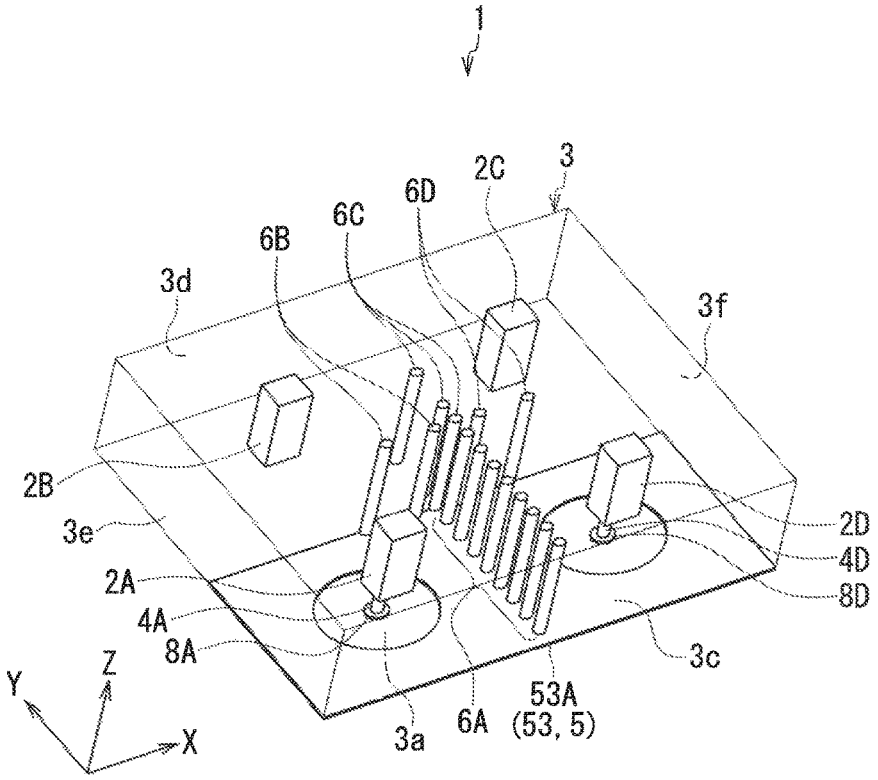
FIG. 5 is a partial internal perspective view of the dielectric filter shown in FIG. 1 and FIG. 3.

A preferred embodiment of the present invention will now be described in detail with reference to the drawings. First, the structure of a dielectric filter according to the embodiment of the invention will be described with reference to FIG. 1 to FIG. 5. FIG. 1 and FIG. 3 are internal perspective views of the dielectric filter according to this embodiment. FIG. 2 and FIG. 4 are external perspective views of the dielectric filter according to this embodiment. FIG. 5 is a partial internal perspective view of the dielectric filter shown in FIG. 1 and FIG. 3.

The dielectric filter 1 according to the embodiment includes: a plurality of resonator bodies each formed of a dielectric material; a surrounding dielectric portion 3 present around the plurality of resonator bodies; a first input/output conductor portion 4A; a second input/output conductor portion 4D; and a shield conductor portion 5.

The surrounding dielectric portion 3 is formed of a dielectric material having a relative permittivity lower than that of the dielectric material used to form the plurality of resonator bodies. The relative permittivity of the dielectric material used to form the surrounding dielectric portion 3 is in the range of, for example, 2 to 10. The relative permittivity of the dielectric material used to form the resonator bodies is preferably 10 or more times that of the dielectric material used to form the surrounding dielectric portion 3.

Each of the first input/output conductor portion 4A, the second input/output conductor portion 4D, and the shield conductor portion 5 is formed of a conductor. The shield conductor portion 5 is located around the plurality of resonator bodies such that at least part of the surrounding dielectric portion 3 is interposed between at least part of the resonator bodies and the shield conductor portion 5.

Of the plurality of resonator bodies, every two resonator bodies that are adjacent to each other in circuit configuration are configured to be electromagnetically coupled to each other. In this application, the phrase "in circuit configuration" is used to describe layout in a circuit diagram, not in a physical configuration. The plurality of resonator bodies include a first input/output stage resonator body 2A and a second input/output stage resonator body 2D. The first input/output conductor portion 4A is configured to perform at least one of supply of an electromagnetic wave to the first input/output stage resonator body 2A and reception of an electromagnetic wave from the first input/output stage resonator body. 2A The second input/output conductor portion 4D is configured to perform at least one of supply of an electromagnetic wave to the second input/output stage resonator body 2D and reception of an electromagnetic wave from the second input/output stage resonator body 2D.

The plurality of resonator bodies may include, in addition to the first and second input/output stage resonator bodies, one or more intermediate resonator bodies located between the first input/output stage resonator body and the second input/output stage resonator body in circuit configuration. In this embodiment, in particular, the plurality of resonator bodies include two intermediate resonator bodies 2B and 2C as the one or more intermediate resonator bodies.

Figure 7:
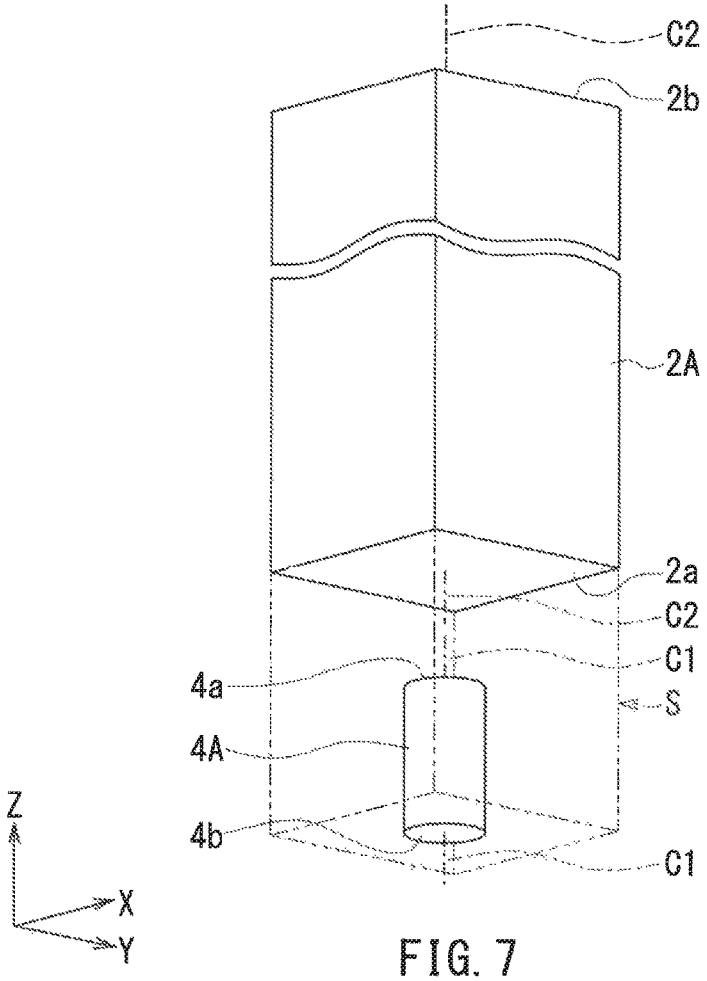
FIG. 7 is a perspective view of a first input/output conductor portion and a first input/output stage resonator body.

X, Y and Z directions are defined here as shown in FIG. 1 to FIG. 5. The X, Y and Z directions are orthogonal to one another. The respective dimensions of the first and second input/output stage resonator bodies 2A and 2D in the Z direction are greater than the respective maximum dimensions of the first and second input/output stage resonator bodies 2A and 2D in a direction orthogonal to the Z direction. Each of the first and second input/output stage resonator bodies 2A and 2D has a first end face 2*a* and a second end face 2*b* located at opposite ends in the Z direction. The first and second end faces 2*a* and 2*b* are shown in FIG. 7 to be described later. In this embodiment, any cross section of the first input/output stage resonator body 2A that is orthogonal to the Z direction has a constant shape irrespective of the distance between the cross section and the first end face 2*a*. Likewise, any cross section of the second input/output stage resonator body 2D that is orthogonal to the Z direction has a constant shape irrespective of the distance between the cross section and the first end face 2*a*. The Z direction corresponds to the first direction in the present invention.

The above description about the shape of the first and second input/output stage resonator bodies 2A and 2D is applicable to the intermediate resonator bodies 2B and 2C. In this embodiment, the resonance mode of all of the resonator bodies 2A, 2B, 2C and 2D is a TM mode.

FIG. 1 to FIG. 5 illustrate an example in which the first and second input/output stage resonator bodies 2A and 2D and the intermediate resonator bodies 2B and 2C are each rectangular solid shaped. However, the shape of the first and second input/output stage resonator bodies 2A and 2D and the intermediate resonator bodies 2B and 2C is not limited to this example, and may be, for example, a cylindrical shape.

The surrounding dielectric portion 3 is rectangular solid shaped and has an external surface. The external surface of the surrounding dielectric portion 3 includes a bottom surface 3*a* and a top surface 3*b* opposite to each other in the Z direction, and four side surfaces 3*c*, 3*d*, 3*e* and 3*f* connecting the bottom surface 3*a* and the top surface 3*b*. The side surfaces 3*c* and 3*d* are opposite to each other in the Y direction. The side surfaces 3*e* and 3*f* are opposite to each other in the X direction. FIG. 1 and FIG. 2 show the dielectric filter 1 as viewed from the side of the top surface 3*b*. FIG. 3 and FIG. 4 show the dielectric filter 1 as viewed from the side of the bottom surface 3*a*.

The first and second input/output stage resonator bodies 2A and 2D are located closer to the side surface 3*c* of the surrounding dielectric portion 3 than are the intermediate resonator bodies 2B and 2C. The first and second input/output stage resonator bodies 2A and 2D are arranged in this order as viewed from the side surface 3*e* of the surrounding dielectric portion 3. The intermediate resonator bodies 2B and 2C are located closer to the side surface 3*d* of the surrounding dielectric portion 3 than are the first and second input/output stage resonator bodies 2A and 2D. The intermediate resonator bodies 2B and 2C are arranged in this order as viewed from the side surface 3*e* of the surrounding dielectric portion 3.

Each of the first and second input/output conductor portions 4A and 4D has a third end face 4*a* and a fourth end face 4*b* located at opposite ends in the Z direction. The third and fourth end faces 4*a* and 4*b* are shown in FIG. 7 to be described later. The first input/output conductor portion 4A is located near the first input/output stage resonator body 2A. The third end face 4*a* of the first input/output conductor portion 4A is located closer to the first end face 2*a* of the first input/output stage resonator body 2A than is the fourth end face 4*b* of the first input/output conductor portion 4A. The first input/output conductor portion 4A is embedded in the surrounding dielectric portion 3 such that the fourth end face 4*b* is exposed on the bottom surface 3*a* of the surrounding dielectric portion 3.

The second input/output conductor portion 4D is located near the second input/output stage resonator body 2D. The third end face 4*a* of the second input/output conductor portion 4D is located closer to the first end face 2*a* of the second input/output stage resonator body 2D than is the fourth end face 4*b* of the second input/output conductor portion 4D. The second input/output conductor portion 4D is embedded in the surrounding dielectric portion 3 such that the fourth end face 4*b* is exposed on the bottom surface 3*a* of the surrounding dielectric portion 3.

A detailed description will be given later concerning the shape of the input/output stage resonator bodies 2A and 2D and the input/output conductor portions 4A and 4D, the positional relationship between the input/output stage resonator body 2A and the input/output conductor portion 4A, and the positional relationship between the input/output stage resonator body 2D and the input/output conductor portion 4D.

The shield conductor portion 5 includes a first internal shield conductor layer 51 and a second internal shield conductor layer 52 located inside the surrounding dielectric portion 3, and an external conductor portion 53 located on the external surface of the surrounding dielectric portion 3.

The external conductor portion 53 includes external shield conductor layers 53A, 53B, 53C, 53D, 53E and 53F. The external shield conductor layer 53A is located on the bottom surface 3*a* of the surrounding dielectric portion 3. The external shield conductor layer 53B is located on the top surface 3*b* of the surrounding dielectric portion 3. The external shield conductor layers 53C, 53D, 53E and 53F are respectively located on the side surfaces 3*c*, 3*d*, 3*e* and 3*f* of the surrounding dielectric portion 3. FIG. 1 and FIG. 3 show the dielectric filter 1 excluding the external shield conductor layers 53B, 53C, 53D, 53E and 53F.

Each of the external shield conductor layers 53A to 53F is connected to other four of the shield conductor layers that are adjacent to its external edges. The external shield conductor layer 53A has a first opening to expose the fourth end face 4*b* of the first input/output conductor portion 4A and a part of the bottom surface 3*a* around this fourth end face 4*b*, and a second opening to expose the fourth end face 4*b* of the second input/output conductor portion 4D and another part of the bottom surface 3*a* around this fourth end face 4*b*.

The distance between the first internal shield conductor layer 51 and each of the resonator bodies 2A, 2B, 2C and 2D is smaller than the distance between at least one of the external shield conductor layers and each of the resonator bodies 2A, 2B, 2C and 2D. In this embodiment, in particular, the distance between the first internal shield conductor layer 51 and each of the resonator bodies 2A, 2B, 2C and 2D is smaller than the distance between any of the external shield conductor layers and each of the resonator bodies 2A, 2B, 2C and 2D.

In this embodiment, the first internal shield conductor layer 51 is in contact with the resonator bodies 2A, 2B, 2C and 2D. More specifically, the first internal shield conductor layer 51 is in contact with the respective second end faces 2*b* of the resonator bodies 2A, 2B, 2C and 2D.

The external conductor portion 53 includes at least one external shield conductor layer having a first conductivity. In this embodiment, in particular, each of the external shield conductor layers 53B, 53C, 53D, 53E and 53F has the first conductivity. The first internal shield conductor layer 51 has a second conductivity higher than the first conductivity. The external shield conductor layer 53A has a conductivity lower than or equal to the second conductivity. The conductivity of the external shield conductor layer 53A may be equal to the first conductivity. The second internal shield conductor layer 52 has a conductivity higher than the first conductivity. The conductivity of the second internal shield conductor layer 52 may be equal to the second conductivity.

As described above, the first and second internal shield conductor layers 51 and 52 are higher in conductivity than at least the external shield conductor layers 53B, 53C, 53D, 53E and 53F of the external conductor portion 53. The difference in conductivity is ascribable to the manufacturing method of the dielectric filter 1 to be described later.

The surrounding dielectric portion 3 includes a plurality of dielectric layers stacked on top of each other. The surrounding dielectric portion 3 further includes a first dielectric portion 3A and a second dielectric portion 3B sandwiching the first internal shield conductor layer 51. The resonator bodies 2A, 2B, 2C and 2D are located in the first dielectric portion 3A. The plurality of dielectric layers will be described in detail later.

The second dielectric portion 3B has a first surface in contact with the first internal shield conductor layer 51, and a second surface opposite to the first surface. The second surface of the second dielectric portion 3B constitutes the top surface 3*b* of the surrounding dielectric portion 3. The external shield conductor layer 53B is located on the second surface of the second dielectric portion 3B.

The first internal shield conductor layer 51 is electrically connected to the external conductor portion 53. In this embodiment, the first internal shield conductor layer 51 is directly electrically connected to the external shield conductor layers 53C to 53F. The dielectric filter 1 includes a plurality of through holes formed in the second dielectric portion 3B and electrically connecting the first internal shield conductor layer 51 and the external shield conductor layer 53B. In this embodiment, a set of through holes connected in series in the Z direction will be referred to as a through hole line. The aforementioned plurality of through holes formed in the second dielectric portion 3B constitute a plurality of through hole lines 6E shown in FIG. 1 and FIG. 3. The first internal shield conductor layer 51 is electrically connected to the external shield conductor layer 53B via the plurality of through hole lines 6E.

The first internal shield conductor layer 51 has a plurality of cutouts. Each of the cutouts is shaped to be recessed inwardly from the periphery of the first internal shield conductor layer 51. The cutouts allow the first dielectric portion 3A and the second dielectric portion 3B to be in partially contact with each other and be joined to each other.

The second internal shield conductor layer 52 is located in the first dielectric portion 3A. The resonator bodies 2A, 2B, 2C and 2D are located between the first internal shield conductor layer 51 and the second internal shield conductor layer 52. The second internal shield conductor layer 52 is directly electrically connected to the external shield conductor layers 53D to 53F. A part of the periphery of the second internal shield conductor layer 52 in the vicinity of the external shield conductor layers 53D to 53F has a plurality of cutouts, which are similar to the cutouts of the first internal shield conductor layer 51. The cutouts allow the two dielectric layers sandwiching the second internal shield conductor layer 52 to be in partially contact with each other and be joined to each other.

As shown in FIG. 1, FIG. 3 and FIG. 5, the dielectric filter 1 further includes a plurality of through hole lines formed in the first dielectric portion 3A. The plurality of through hole lines include a plurality of through hole lines 6A, a plurality of through hole lines 6B, a plurality of through hole lines 6C, a plurality of through hole lines 6D, and a plurality of through hole lines 6F. The plurality of through hole lines 6A are interposed between the first input/output stage resonator body 2A and the second input/output stage resonator body 2D. The plurality of through hole lines 6B are interposed between the first input/output stage resonator body 2A and the intermediate resonator body 2B. The plurality of through hole lines 6C are interposed between the intermediate resonator body 2B and the intermediate resonator body 2C. The plurality of through hole lines 6D are interposed between the intermediate resonator body 2C and the second input/output stage resonator body 2D. The plurality of through hole lines 6F electrically connect the second internal shield conductor layer 52 and the external shield conductor layer 53A.

The dielectric filter 1 further includes a first input/output terminal 8A and a second input/output terminal 8D located on the bottom surface 3*a* of the surrounding dielectric portion 3. The first input/output terminal 8A is connected to the fourth end face 4*b* of the first input/output conductor portion 4A. The second input/output terminal 8D is connected to the fourth end face 4*b* of the second input/output conductor portion 4D.

The dielectric filter 1 includes a plurality of dielectric resonators. Each dielectric resonator includes one resonator body, the surrounding dielectric portion 3, and the shield conductor portion 5. The surrounding dielectric portion 3 and the shield conductor portion 5 are used in common to form the plurality of dielectric resonators.

Figure 6:
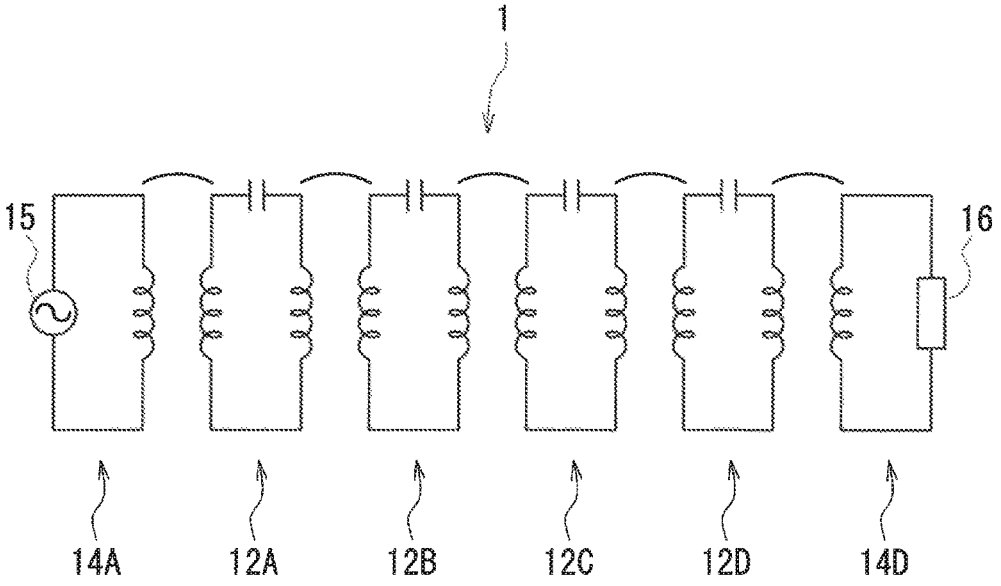
FIG. 6 is an equivalent circuit diagram of the dielectric filter shown in FIG. 1 to FIG. 4.

The plurality of dielectric resonators include a first input/output stage resonator 12A and a second input/output stage resonator 12D. The reference signs 12A and 12D are not shown in FIG. 1 to FIG. 5, but are shown in FIG. 6 to be described later. The first input/output stage resonator 12A includes the first input/output stage resonator body 2A, the surrounding dielectric portion 3, and the shield conductor portion 5. The second input/output stage resonator 12D includes the second input/output stage resonator body 2D, the surrounding dielectric portion 3, and the shield conductor portion 5.

When the plurality of resonator bodies include one or more intermediate resonator bodies, the plurality of dielectric resonators include one or more intermediate resonators in addition to the first and second input/output stage resonators 12A and 12D. The one or more intermediate resonators are located between the first input/output stage resonator 12A and the second input/output stage resonator 12D in circuit configuration. Each intermediate resonator includes one intermediate resonator body, the surrounding dielectric portion and the shield conductor portion. In this embodiment, in particular, the plurality of dielectric resonators include two intermediate resonators 12B and 12C as the one or more intermediate resonators. The reference signs 12B and 12C are not shown in FIG. 1 to FIG. 5, but are shown in FIG. 6 to be described later. The intermediate resonator 12B includes the intermediate resonator body 2B, the surrounding dielectric portion 3, and the shield conductor portion 5. The intermediate resonator 12C includes the intermediate resonator body 2C, the surrounding dielectric portion 3, and the shield conductor portion 5.

The first internal shield conductor layer 51 of the shield conductor portion 5 is a component of the resonators 12A, 12B, 12C and 12D. The second internal shield conductor layer 52 of the shield conductor portion 5 is a component of the resonators 12B and 12C, and not a component of the resonators 12A and 12D.

The shield conductor portion 5 has the function of confining electromagnetic waves emitted from the resonator bodies 2A, 2B, 2C and 2D to thereby reduce a radiation loss. A description will be given later concerning the reason for the inclusion of the first and second internal shield conductor layers 51 and 52 in the shield conductor portion 5 of this embodiment. The plurality of through hole lines 6E electrically connect the first internal shield conductor layer 51 and the external shield conductor layer 53B to enhance the aforementioned function of the shield conductor portion 5. Likewise, the plurality of through hole lines 6F electrically connect the second internal shield conductor layer 52 and the external shield conductor layer 53A to enhance the aforementioned function of the shield conductor portion 5.

Now, the shapes of the first and second input/output stage resonator bodies 2A and 2D and the first and second input/output conductor portions 4A and 4D will be described with reference to FIG. 1 and FIG. 7. FIG. 7 is a perspective view of the first input/output conductor portion 4A and the first input/output stage resonator body 2A. As shown in FIG. 7, the first input/output conductor portion 4A is preferably smaller than the first input/output stage resonator body 2A in maximum dimension in a direction orthogonal to the Z direction (the first direction). Likewise, the second input/output conductor portion 4D is preferably smaller than the second input/output stage resonator body 2D in maximum dimension in the direction orthogonal to the Z direction.

The first and second input/output conductor portions 4A, 4D and the first and second input/output stage resonator bodies 2A, 2D both preferably have shapes having three-fold or higher rotational symmetry about an axis parallel to the Z direction (the first direction), and more preferably, four-fold or higher rotational symmetry about the axis parallel to the Z direction. The shapes having three-fold or higher rotational symmetry about the axis parallel to the Z direction include a shape that is circular in cross section orthogonal to the Z direction.

FIG. 1 illustrates an example in which the first and second input/output conductor portions 4A, 4D and the first and second input/output stage resonator bodies 2A, 2D both have shapes having four-fold or higher rotational symmetry about the axis parallel to the Z direction (the first direction) (hereinafter referred to as the central axis). In FIG. 7, the reference sign C1 denotes the central axis of the first input/output conductor portion 4A, and the reference numeral C2 denotes the central axis of the first input/output stage resonator body 2A.

In the example shown in FIG. 1, the first and second input/output conductor portions 4A and 4D are shaped to be circular in cross section orthogonal to the Z direction. However, the shape of the first and second input/output conductor portions 4A and 4D is not limited to this example, and may be, for example, square in cross section orthogonal to the Z direction.

Further, in the example shown in FIG. 1, the first and second input/output stage resonator bodies 2A and 2D are shaped to be square in cross section orthogonal to the Z direction. However, the shape of the first and second input/output stage resonator bodies 2A and 2D is not limited to this example, and may be, for example, circular in cross section orthogonal to the Z direction.

Reference is now made to FIG. 6 to describe the circuit configuration of the dielectric filter 1. FIG. 6 shows an equivalent circuit of the dielectric filter 1. As shown in FIG. 6, the dielectric filter 1 includes a first input/output portion 14A and a second input/output portion 14D, in addition to the first input/output stage resonator 12A, the first intermediate resonator 12B, the second intermediate resonator 12C and the second input/output stage resonator 12D mentioned above.

The first input/output portion 14A is composed of the first input/output terminal 8A and the first input/output conductor portion 4A. The second input/output portion 14D is composed of the second input/output terminal 8D and the second input/output conductor portion 4D.

In circuit configuration, the first input/output stage resonator 12A, the first intermediate resonator 12B, the second intermediate resonator 12C, and the second input/output stage resonator 12D are arranged in this order between the first input/output portion 14A and the second input/output portion 14D, the first input/output stage resonator 12A being closest to the first input/output portion 14A.

Each of the resonators 12A, 12B, 12C and 12D has an inductance and a capacitance.

Every two resonators that are adjacent to each other in circuit configuration are configured to be electromagnetically coupled to each other. The first input/output portion 14A and the first input/output stage resonator 12A are also configured to be electromagnetically coupled to each other. The second input/output portion 14D and the second input/output stage resonator 12D are also configured to be electromagnetically coupled to each other.

FIG. 6 illustrates an example in which a signal source 15 is connected to the first input/output portion 14A and a load 16 is connected to the second input/output portion 14D. Alternatively, the signal source 15 may be connected to the second input/output portion 14D and the load 16 may be connected to the first input/output portion 14A.

The dielectric filter 1 constitutes a band-pass filter. The main parameters that determine the characteristics of the band-pass filter constituted of the dielectric filter 1 are the resonant frequency of each of the resonators 12A, 12B, 12C and 12D, the coupling coefficient between each of a plurality of pairs of electromagnetically coupled elements, a first external Q resulting from the electromagnetic coupling between the first input/output portion 14A and the first input/output stage resonator 12A, and a second external Q resulting from the electromagnetic coupling between the second input/output portion 14D and the second input/output stage resonator 12D.

The first external Q depends on the electromagnetic coupling between the first input/output portion 14A and the first input/output stage resonator 12A, and decreases with increasing strength of this electromagnetic coupling. Likewise, the second external Q depends on the electromagnetic coupling between the second input/output portion 14D and the second input/output stage resonator 12D, and decreases with increasing strength of this electromagnetic coupling.

The fractional bandwidth of the band-pass filter constituted of the dielectric filter 1 is inversely proportional to the first and second external Qs. Thus, to increase the fractional bandwidth of this band-pass filter, reductions in the first and second external Qs, in other words, an increase in the strength of the electromagnetic coupling between the first input/output portion 14A and the first input/output stage resonator 12A and an increase in the strength of the electromagnetic coupling between the second input/output portion 14D and the second input/output stage resonator 12D are effective.

In this embodiment, the electromagnetic coupling between the first input/output portion 14A and the first input/output stage resonator 12A is derived from electromagnetic coupling between the first input/output conductor portion 4A and the first input/output stage resonator body 2A. The electromagnetic coupling between the second input/output portion 14D and the second input/output stage resonator 12D is derived from electromagnetic coupling between the second input/output conductor portion 4D and the second input/output stage resonator body 2D.

This embodiment enables an increase in the strength of the electromagnetic coupling between the first input/output conductor portion 4A and the first input/output stage resonator body 2A and an increase in the strength of the electromagnetic coupling between the second input/output conductor portion 4D and the second input/output stage resonator body 2D. Thus, according to this embodiment, it is possible to reduce the first and second external Qs to thereby increase the fractional bandwidth of the band-pass filter constituted of the dielectric filter 1. The reason therefor will be described below in detail.

FIG. 7 shows the positional relationship between the first input/output conductor portion 4A and the first input/output stage resonator body 2A. As shown in FIG. 7, let us assume a first space S formed by shifting a virtual plane corresponding to the first end face 2*a* of the first input/output stage resonator body 2A in the Z direction (the first direction) away from the second end face 2*b* of the first input/output stage resonator body 2A. The first input/output conductor portion 4A is located either such that at least part of the first input/output conductor portion 4A is contained in the first space S or such that the first input/output conductor portion 4A is in contact with the first space S. The first input/output conductor portion 4A is preferably located such that at least part of the first input/output conductor portion 4A is contained in the first space S, and more preferably such that the entirety of the first input/output conductor portion 4A is contained in the first space S.

Figure 8:
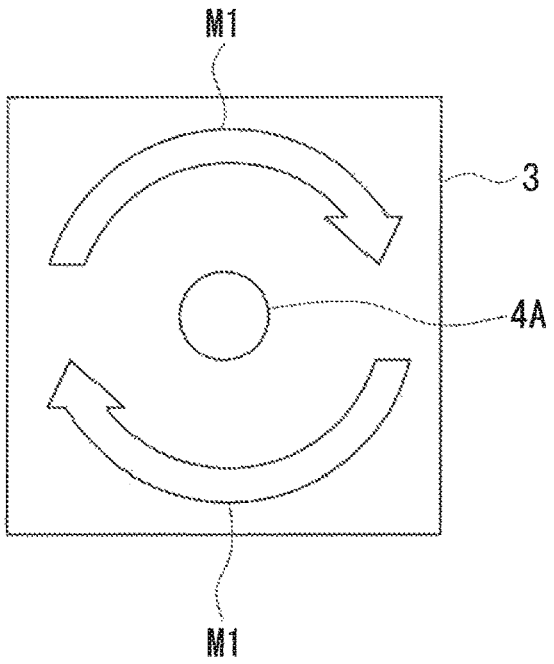
FIG. 8 is an explanatory diagram schematically illustrating a magnetic field occurring around the first input/output conductor portion.
Figure 9:
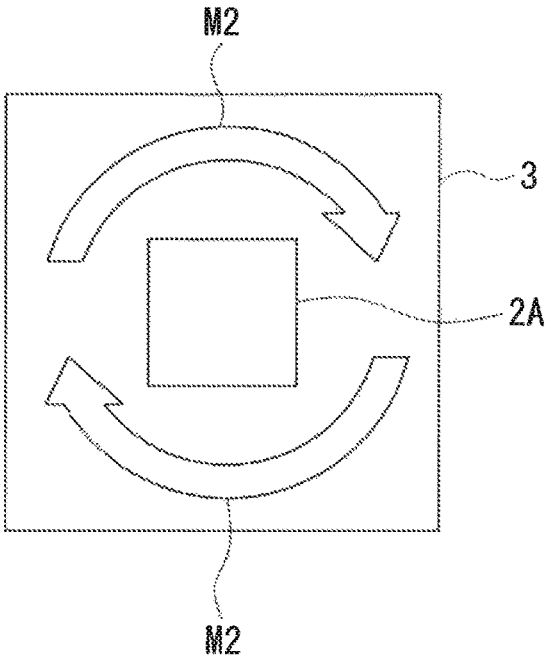
FIG. 9 is an explanatory diagram schematically illustrating a magnetic field occurring around the first input/output stage resonator body.

FIG. 8 schematically illustrates a magnetic field M1 that occurs around the first input/output conductor portion 4A when a signal current flows through the first input/output conductor portion 4A in the first direction. FIG. 9 schematically illustrates a magnetic field M2 that occurs around the first input/output stage resonator body 2A when resonance occurs in the first input/output stage resonator 12A. In FIGS. 8 and 9, a direction perpendicular to the plane of the drawing is the Z direction, i.e., the first direction. The magnetic lines of force corresponding to the magnetic field M1 and the magnetic lines of force corresponding to the magnetic field M2 are both distributed in such a manner as to rotate about axes that are parallel to the Z direction (the first direction). In other words, the distributions of those magnetic lines of force are similar to each other. For this reason, according to this embodiment, it is possible to increase the strength of the electromagnetic coupling, particularly the magnetic coupling, between the first input/output conductor portion 4A and the first input/output stage resonator body 2A. This embodiment thereby enables a reduction in the first external Q.

Although not illustrated, the positional relationship between the second input/output conductor portion 4D and the second input/output stage resonator body 2D is the same as the positional relationship between the first input/output conductor portion 4A and the first input/output stage resonator body 2A shown in FIG. 7. More specifically, we assume a second space that is formed by shifting a virtual plane corresponding to the first end face 2*a* of the second input/output stage resonator body 2D in the Z direction (the first direction) away from the second end face 2*b* of the second input/output stage resonator body 2D. The second input/output conductor portion 4D is located either such that at least part of the second input/output conductor portion 4D is contained in the second space or such that the second input/output conductor portion 4D is in contact with the second space. The second input/output conductor portion 4D is preferably located such that at least part of the second input/output conductor portion 4D is contained in the second space, and more preferably such that the entirety of the second input/output conductor portion 4D is contained in the second space. According to this embodiment, it is possible to increase the strength of the electromagnetic coupling, particularly the magnetic coupling, between the second input/output conductor portion 4D and the second input/output stage resonator body 2D. This embodiment thereby enables a reduction in the second external Q.

In this embodiment, the strength of the electromagnetic coupling between the first input/output conductor portion 4A and the first input/output stage resonator body 2A varies depending on the shape of the first input/output conductor portion 4A and the positional relationship between the first input/output conductor portion 4A and the first input/output stage resonator body 2A. Accordingly, in this embodiment, the first external Q is adjustable by varying the shape of the first input/output conductor portion 4A and the positional relationship between the first input/output conductor portion 4A and the first input/output stage resonator body 2A.

Figure 10:
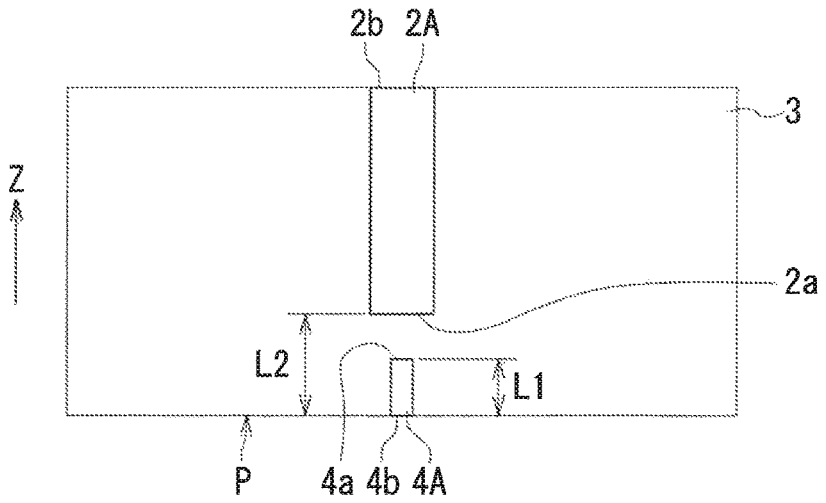
FIG. 10 is an explanatory diagram for explaining the positional relationship between the first input/output conductor portion and the first input/output stage resonator body.

An example of the method for adjusting the first external Q will be described with reference to FIG. 10 and FIG. 11. FIG. 10 is an explanatory diagram for explaining the positional relationship between the first input/output conductor portion 4A and the first input/output stage resonator body 2A. First, as shown in FIG. 10, we let L1 represent the dimension of the first input/output conductor portion 4A in the Z direction (the first direction). Further, we let L2 represent the distance between the first end face 2*a* of the first input/output stage resonator body 2A and a virtual plane P that includes the fourth end face 4*b* of the first input/output conductor portion 4A and is parallel to the first end face 2*a* of the first input/output stage resonator body 2A. The first external Q varies depending on the value of L1/L2.

Now, a description will be given of the results of a first simulation that examined the relationship between L1/L2 and the first external Q. In the first simulation, with the central axis C1 of the first input/output conductor portion 4A and the central axis C2 of the first input/output stage resonator body 2A made coincide with each other and with L2 set at 220 μm, L1/L2 was varied by varying L1.

Figure 11:
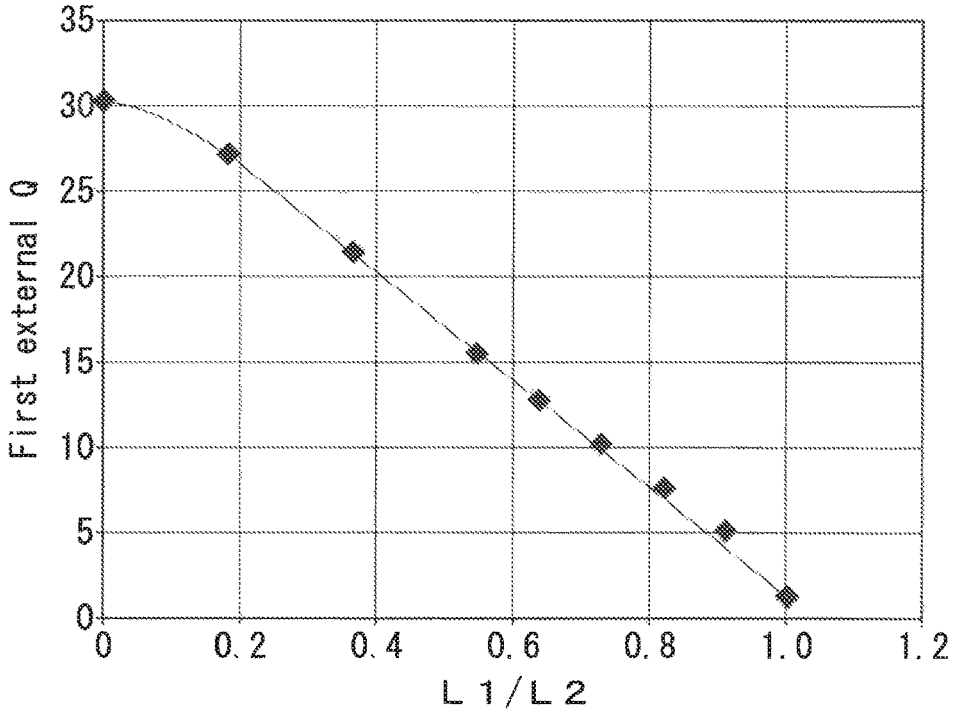
FIG. 11 is a characteristic diagram illustrating the relationship between the ratio between L1 and L2 shown in FIG. 10 and a first external Q.

FIG. 11 is a characteristic diagram illustrating the relationship between L1/L2 and the first external Q determined by the first simulation. In FIG. 11, the horizontal axis represents L1/L2, and the vertical axis represents the first external Q. As shown in FIG. 11, the first external Q decreases with increasing L1/L2. Thus, the first external Q is adjustable using the value of L1/L2.

When L1/L2 is in the range of 0.2 to 1, the first external Q changes at an approximately constant rate with respect to a change of L1/L2. Thus, when L1/L2 is in the range of 0.2 to 1, the first external Q is easily adjustable using the value of L1/L2. The first external Q is lower by 5% or more when L1/L2 is in the range of 0.2 to 1 than when L1/L2 is 0, in other words, L1 is 0. In view of the these findings, L1/L2 is preferably in the range of 0.2 to 1. In other words, L1 is preferably in the range of 0.2 to 1 times L2.

As mentioned above, the first external Q decreases with increasing L1/L2. From the viewpoint of increasing the fractional bandwidth of the band-pass filter constituted of the dielectric filter 1, it is more preferable that L1/L2 be in the range of 0.5 to 1.

Figure 12:
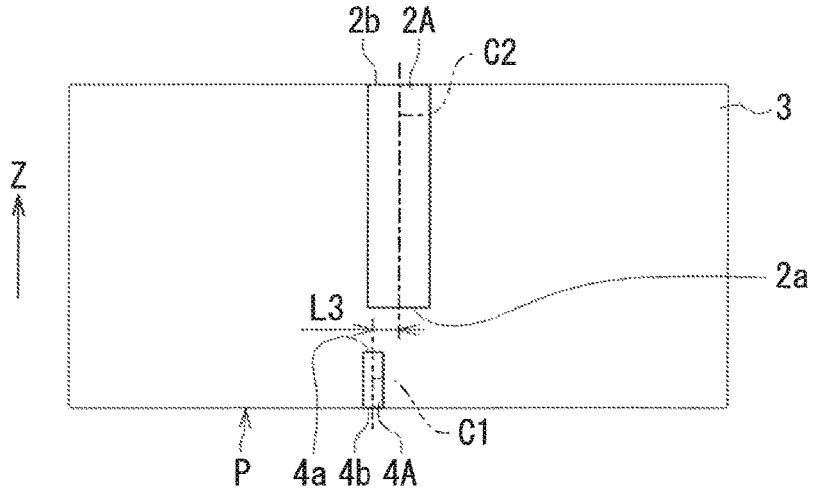
FIG. 12 is an explanatory diagram for explaining the positional relationship between the first input/output conductor portion and the first input/output stage resonator body.

Next, the results of a second simulation will be described with reference to FIG. 12 and FIG. 13. FIG. 12 is an explanatory diagram for explaining the positional relationship between the first input/output conductor portion 4A and the first input/output stage resonator body 2A. As shown in FIG. 12, the second simulation examined the relationship between a center deviation amount L3 and the first external Q, the center deviation amount L3 being defined as the amount of misalignment between the central axis C1 of the first input/output conductor portion 4A and the central axis C2 of the first input/output stage resonator body 2A. In the second simulation, the first end face 2*a* of the first input/output stage resonator body 2A was assumed to be in the shape of a square with a side of 200 μm. L1 shown in FIG. 10 was set at 200 μm, and L2 shown in FIG. 10 was set at 220 μm.

Figure 13:
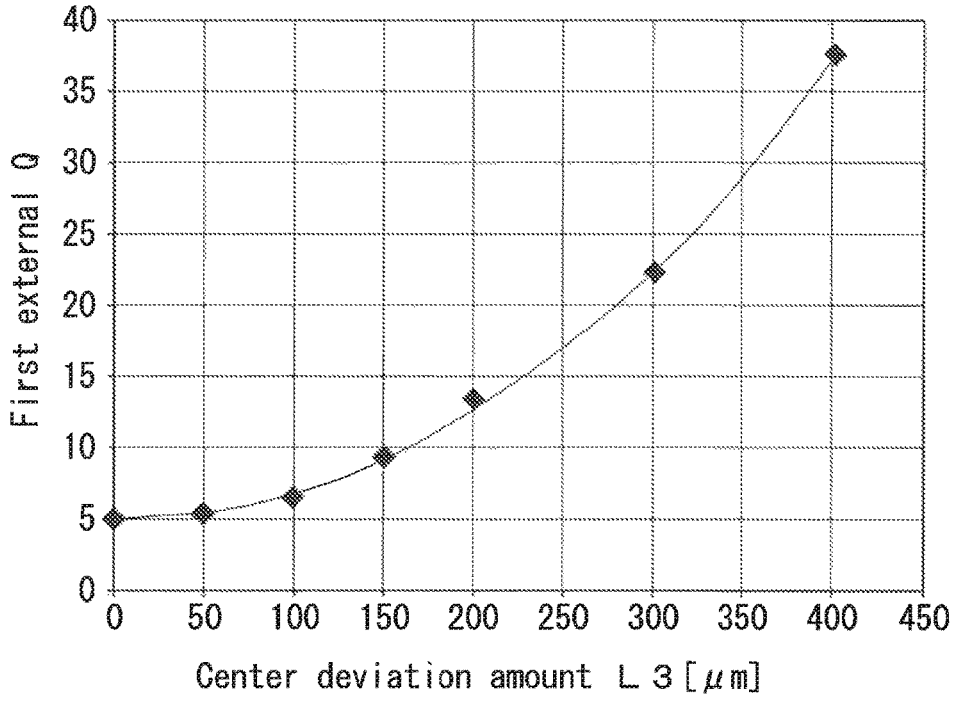
FIG. 13 is a characteristic diagram illustrating the relationship between L3 shown in FIG. 12 and the first external Q.

FIG. 13 is a characteristic diagram illustrating the relationship between the center deviation amount L3 and the first external Q determined by the second simulation. In FIG. 13, the horizontal axis represents the center deviation amount L3, and the vertical axis represents the first external Q. As shown in FIG. 13, the first external Q increases with increasing center deviation amount L3. Further, the larger the center deviation amount L3, the higher the rate of change of the first external Q with respect to a change of the center deviation amount L3. An increase in the rate causes an increase in variations of the first external Q owing to relative positional variations of the first input/output conductor portion 4A with respect to the first input/output stage resonator body 2A.

In the second simulation, an inscribed circle of a drawing that represents the outer edge of the first end face 2*a* of the first input/output stage resonator body 2A has a radius of 100 μm. As shown in FIG. 13, when the center deviation amount L3 is in the range of 0 to 100 μm, the first external Q is sufficiently small, and the rate of change of the first external Q with respect to a change of the center deviation amount L3 is also sufficiently small. Thus, the center deviation amount L3 is preferably smaller than or equal to the radius of the aforementioned inscribed circle. If the center deviation amount L3 is smaller than or equal to the radius of the inscribed circle, at least part of the first input/output conductor portion 4A is necessarily contained in the first space S shown in FIG. 7. From this point of view also, the center deviation amount L3 is preferably smaller than or equal to the radius of the inscribed circle.

A preferable positional relationship between the second input/output conductor portion 4D and the second input/output stage resonator body 2D is similar to that between the first input/output conductor portion 4A and the first input/output stage resonator body 2A.

As has been described, this embodiment enables reducing the first and second external Qs, and consequently enables increasing the fractional bandwidth of the dielectric filter 1.

Figure 14:
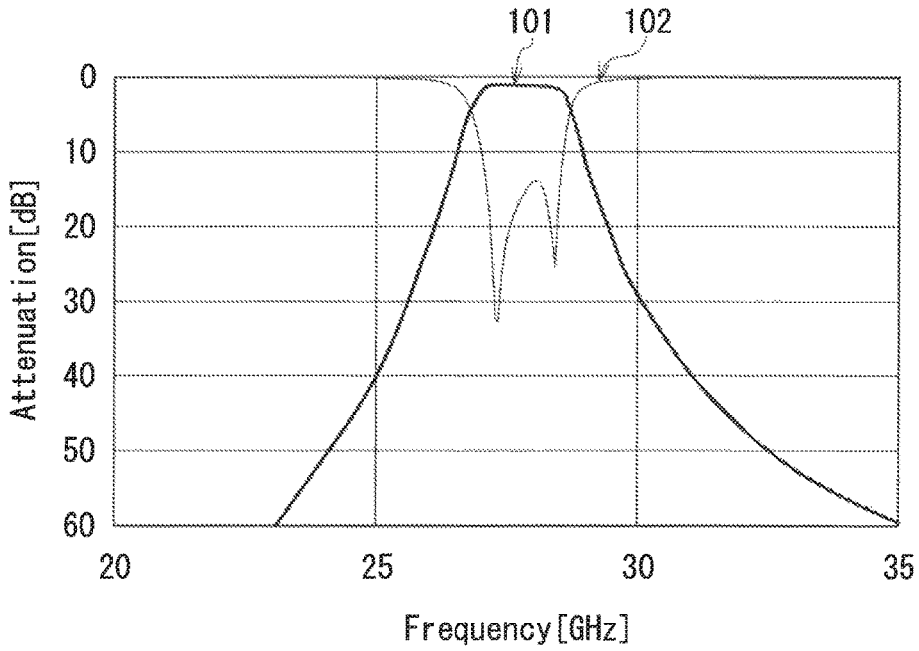
FIG. 14 is a characteristic diagram illustrating an example of the insertion loss characteristic and the return loss characteristic of the dielectric filter according to the embodiment of the invention.

FIG. 14 is a characteristic diagram illustrating an example of the insertion loss characteristic and the return loss characteristic of the dielectric filter 1 according to this embodiment. In FIG. 14, the horizontal axis represents frequency, and the vertical axis represents attenuation. Further, in FIG. 14, the curve labeled 101 represents an example of the insertion loss characteristic of the dielectric filter 1, and the curve labeled 102 represents an example of the return loss characteristic of the dielectric filter 1.

Figure 15:
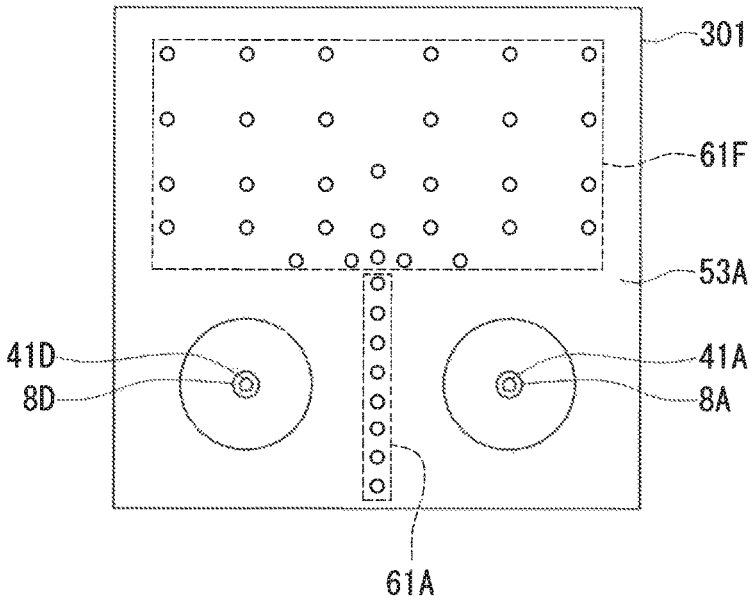
FIG. 15 is an explanatory diagram illustrating a surface of a first dielectric layer of the dielectric filter shown in FIG. 1 to FIG. 4.
Figure 16:
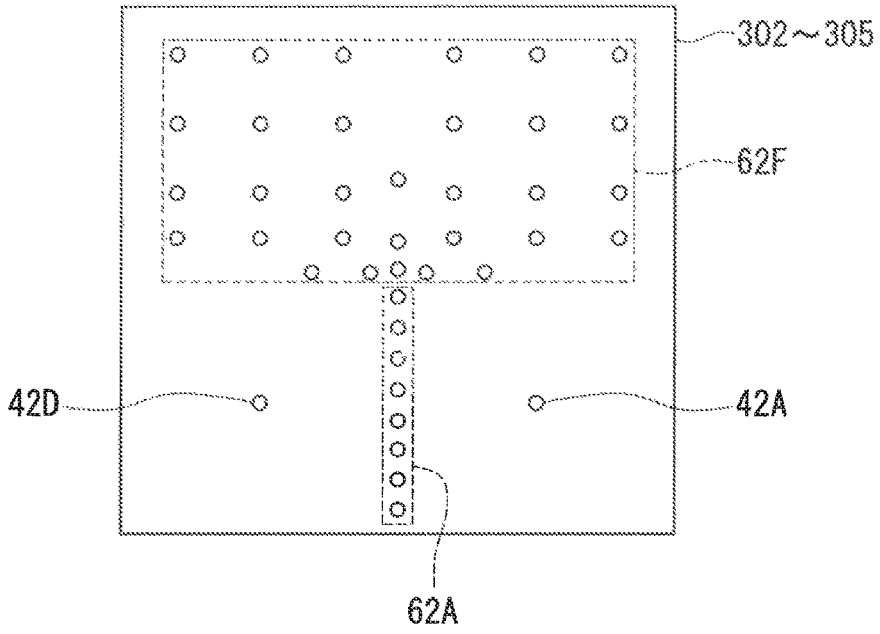
FIG. 16 is an explanatory diagram illustrating a surface of each of a second to a fifth dielectric layer of the dielectric filter shown in FIG. 1 to FIG. 4.
Figure 17:
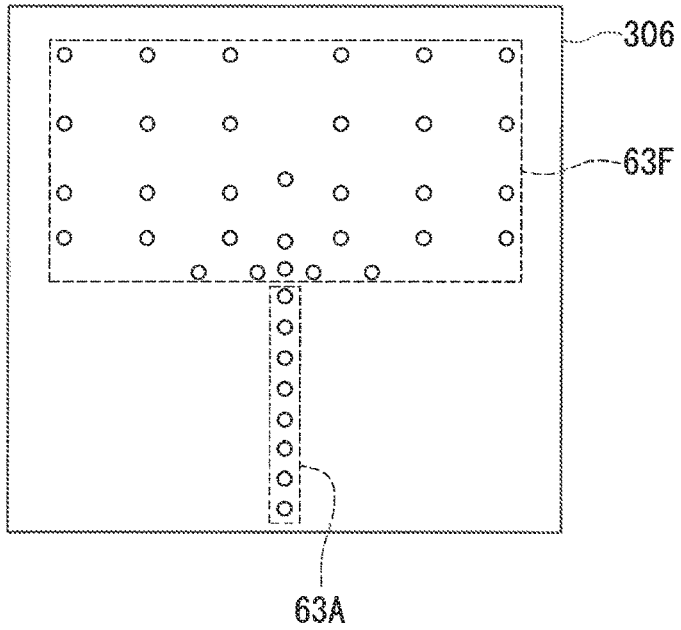
FIG. 17 is an explanatory diagram illustrating a surface of a sixth dielectric layer of the dielectric filter shown in FIG. 1 to FIG. 4.
Figure 18:
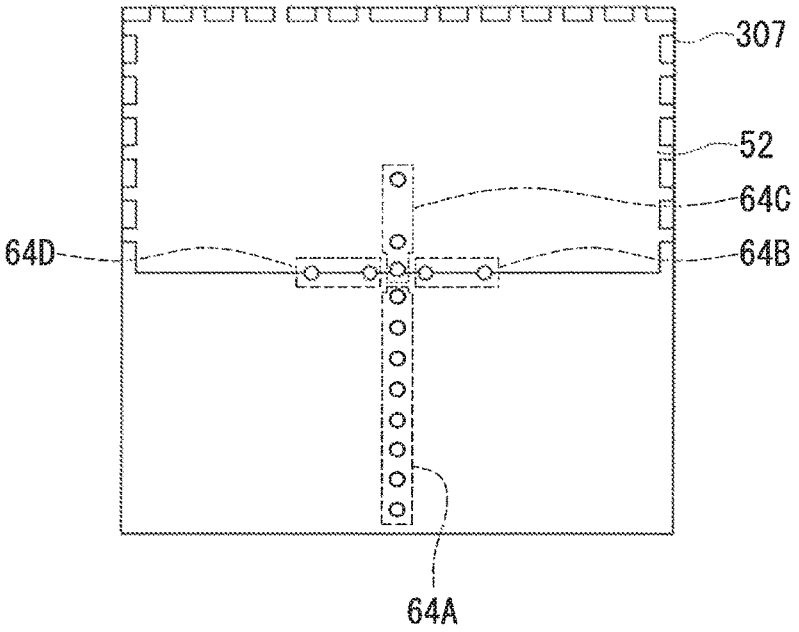
FIG. 18 is an explanatory diagram illustrating a surface of a seventh dielectric layer of the dielectric filter shown in FIG. 1 to FIG. 4.
Figure 19:
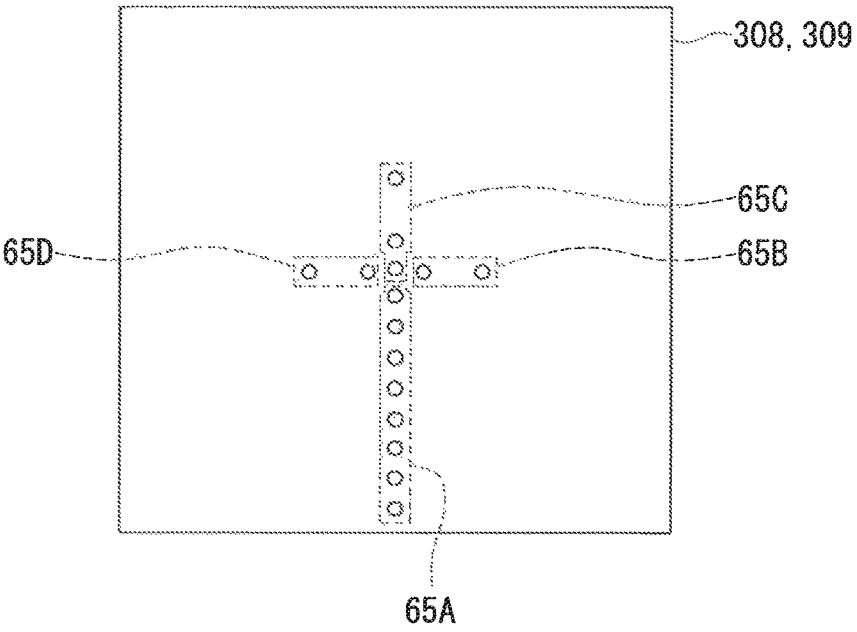
FIG. 19 is an explanatory diagram illustrating a surface of each of an eighth and a ninth dielectric layer of the dielectric filter shown in FIG. 1 to FIG. 4.
Figure 20:
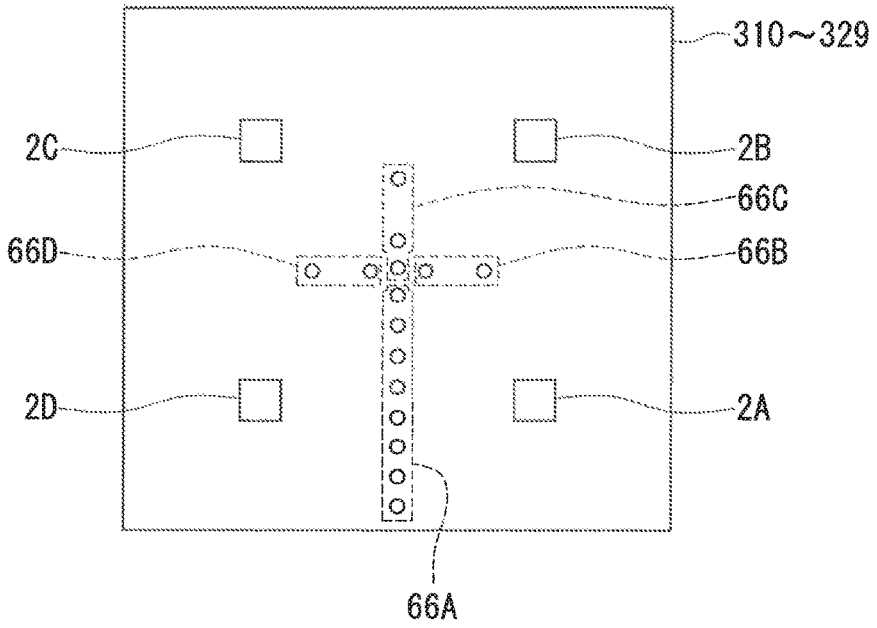
FIG. 20 is an explanatory diagram illustrating a surface of each of a tenth to a twenty-ninth dielectric layer of the dielectric filter shown in FIG. 1 to FIG. 4.
Figure 21:
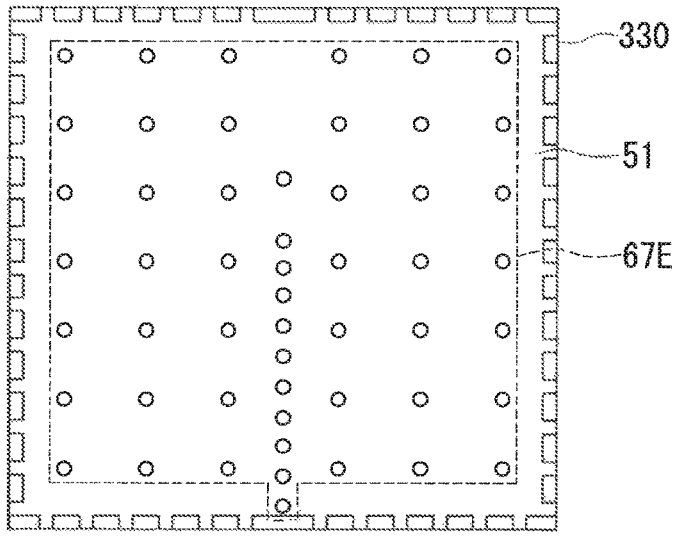
FIG. 21 is an explanatory diagram illustrating a surface of a thirtieth dielectric layer of the dielectric filter shown in FIG. 1 to FIG. 4.
Figure 22:
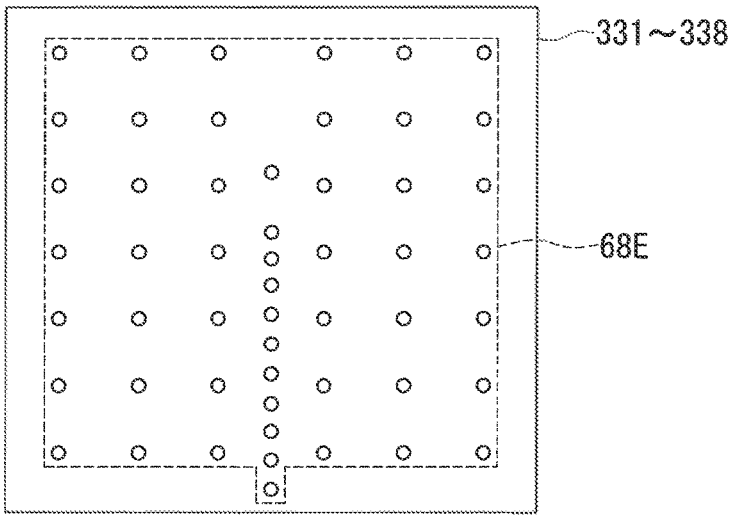
FIG. 22 is an explanatory diagram illustrating a surface of each of a thirty-first to a thirty-eighth dielectric layer of the dielectric filter shown in FIG. 1 to FIG. 4.

Reference is now made to FIG. 15 to FIG. 22 to describe the plurality of dielectric layers of the surrounding dielectric portion 3. The surrounding dielectric portion 3 includes thirty-eight dielectric layers stacked on top of each other. The thirty-eight dielectric layers will be referred to as the first to the thirty-eighth dielectric layers in the order from bottom to top. FIG. 15 shows a surface of the first dielectric layer. FIG. 16 shows a surface of each of the second to the fifth dielectric layer. FIG. 17 shows a surface of the sixth dielectric layer. FIG. 18 shows a surface of the seventh dielectric layer. FIG. 19 shows a surface of each of the eighth and the ninth dielectric layer. FIG. 20 shows a surface of each of the tenth to the twenty-ninth dielectric layer. FIG. 21 shows a surface of the thirtieth dielectric layer. FIG. 22 is shows a surface of each of the thirty-first to the thirty-eighth dielectric layer. All of the respective surfaces of the dielectric layers shown in FIG. 15 to FIG. 22 are the downward-facing surfaces in FIG. 1 to FIG. 4. The first to the thirty-eighth dielectric layer will be denoted by the reference numerals 301 to 338, respectively.

As shown in FIG. 15, the external shield conductor layer 53A and the first and second input/output terminals 8A and 8D are formed on the surface of the first dielectric layer 301. Further, a through hole 41A for forming the first input/output conductor portion 4A, a through hole 41D for forming the second input/output conductor portion 4D, a plurality of through holes 61A for forming the plurality of through hole lines 6A, and a plurality of through holes 61F for forming the plurality of through hole lines 6F are formed in the dielectric layer 301. The through holes 41A and 41D are connected to the first and second input/output terminals 8A and 8D, respectively. The plurality of through holes 61A and the plurality of through holes 61F are connected to the external shield conductor layer 53A.

As shown in FIG. 16, a through hole 42A for forming the first input/output conductor portion 4A, a through hole 42D for forming the second input/output conductor portion 4D, a plurality of through holes 62A for forming the plurality of through hole lines 6A, and a plurality of through holes 62F for forming the plurality of through hole lines 6F are formed in each of the second to fifth dielectric layers 302 to 305.

As shown in FIG. 17, a plurality of through holes 63A for forming the plurality of through hole lines 6A and a plurality of through holes 63F for forming the plurality of through hole lines 6F are formed in the sixth dielectric layer 306.

As shown in FIG. 18, the second internal shield conductor layer 52 is formed on the surface of the seventh dielectric layer 307. Further, a plurality of through holes 64A for forming the plurality of through hole lines 6A, a plurality of through holes 64B for forming the plurality of through hole lines 6B, a plurality of through holes 64C for forming the plurality of through hole lines 6C, and a plurality of through holes 64D for forming the plurality of through hole lines 6D are formed in the dielectric layer 307. The plurality of through holes 64B, the plurality of through holes 63C and the plurality of through holes 64D, and also the plurality of through holes 63F shown in FIG. 17 are connected to the second internal shield conductor layer 52.

As shown in FIG. 19, a plurality of through holes 65A for forming the plurality of through hole lines 6A, a plurality of through holes 65B for forming the plurality of through hole lines 6B, a plurality of through holes 65C for forming the plurality of through hole lines 6C, and a plurality of through holes 65D for forming the plurality of through hole lines 6D are formed in each of the eighth and ninth dielectric layers 308 and 309.

As shown in FIG. 20, a plurality of through holes 66A for forming the plurality of through hole lines 6A, a plurality of through holes 66B for forming the plurality of through hole lines 6B, a plurality of through holes 66C for forming the plurality of through hole lines 6C, and a plurality of through holes 66D for forming the plurality of through hole lines 6D are formed in each of the tenth to twenty-ninth dielectric layers 310 to 329. The first and second input/output stage resonator bodies 2A and 2D and the intermediate resonator bodies 2B and 2C are provided to extend through the dielectric layers 310 to 329.

As shown in FIG. 21, the first internal shield conductor layer 51 is formed on the surface of the thirtieth dielectric layer 330. Further, a plurality of through holes 67E for forming the plurality of through hole lines 6E are formed in the dielectric layer 330.

As shown in FIG. 22, a plurality of through holes 68E for forming the plurality of through hole lines 6E are formed in each of the thirty-first to thirty-eighth dielectric layers 331 to 338.

The dielectric filter 1, excluding the external shield conductor layers 53B, 53C, 53D, 53E and 53F, is constituted of the first to thirty-eighth dielectric layers 301 to 338 stacked such that the surface of the first dielectric layer 301 shown in FIG. 15 serves as the bottom surface 3*a* of the surrounding dielectric portion 3.

In this embodiment, the first input/output conductor portion 4A is constituted of the one through hole 41A and the four through holes 42A connected in series in the Z direction. The second input/output conductor portion 4D is constituted of the one through hole 41D and the four through holes 42D connected in series in the Z direction.

Now, a description will be given of a manufacturing method for the dielectric filter 1 according to this embodiment. The manufacturing method for the dielectric filter 1 includes the steps of: fabricating a multilayer structure including the surrounding dielectric portion 3, the resonator bodies 2A, 2B, 2C and 2D, the first and second input/output conductor portions 4A and 4D, the first and second internal shield conductor layers 51 and 52 and the plurality of through hole lines in the surrounding dielectric portion 3; and forming the external conductor portion 53 and the first and second input/output terminals 8A and 8D.

The step of fabricating the multilayer structure includes the steps of: fabricating an unfired multilayer structure including a plurality of unfired ceramic sheets, which are to become the dielectric layers 301 to 338, and two unfired internal shield conductor layers, which are to become the first and second internal shield conductor layers 51 and 52; and forming the surrounding dielectric portion 3 and the first and second internal shield conductor layers 51 and 52 by firing the unfired multilayer structure. The aforementioned two unfired internal shield conductor layers are formed using a conductive paste.

In each of the unfired ceramic sheets, there are formed a plurality of unfired through holes, which are to become the through holes shown in FIG. 15 to FIG. 22. Those unfired through holes are fired when firing the unfired multilayer structure, and thereby become the through holes shown in FIG. 15 to FIG. 22.

In the step of fabricating the unfired multilayer structure, the resonator bodies 2A, 2B, 2C and 2D are embedded into the unfired multilayer structure in the following manner. First, a part of the unfired multilayer structure is formed by stacking unfired ceramic sheets that are to become the dielectric layers 310 to 329 shown in FIG. 20. Next, four accommodating portions for accommodating the resonator bodies 2A, 2B, 2C and 2D are formed in the part of the unfired multilayer structure. Next, the resonator bodies 2A, 2B, 2C, and 2D are accommodated in the four accommodating portions. Next, unfired ceramic sheets that are to form the remaining part of the unfired multilayer structure are stacked on the aforementioned part of the unfired multilayer structure to thereby complete the unfired multilayer structure.

The step of forming the external conductor portion 53 and the first and second input/output terminals 8A and 8D includes the step of forming at least one external shield conductor layer concurrently with or after the step of fabricating the multilayer structure.

A first to a third example of the step of forming the external conductor portion 53 and the first and second input/output terminals 8A and 8D will now be described.

In the first example, an unfired external shield conductor layer that is to become the external shield conductor layer 53A and two unfired input/output terminals that are to become the first and second input/output terminals 8A and 8D are formed using a conductive paste on an unfired ceramic sheet that is to become the dielectric layer 301, whereby the unfired multilayer structure including these parts is fabricated. The unfired external shield conductor layer and the two unfired input/output terminals are fired when firing the unfired multilayer structure, and thereby become the external shield conductor layer 53A and the first and second input/output terminals 8A and 8D. Thus, in the first example, the external shield conductor layer 53A and the first and second input/output terminals 8A and 8D are formed concurrently with the step of fabricating the multilayer structure. In the first example, five unfired conductor layers that are to become the external shield conductor layers 53B, 53C, 53D, 53E and 53F are formed using a conductive paste on the surfaces of the multilayer structure, and fired to form the external shield conductor layers 53B, 53C, 53D, 53E and 53F. Thus, in the first example, the external shield conductor layers 53B, 53C, 53D, 53E and 53F are formed after the step of fabricating the multilayer structure.

In the second example, the unfired multilayer structure is formed in the same manner as in the first example, and then five unfired conductor layers that are to become the external shield conductor layers 53B, 53C, 53D, 53E and 53F are formed on the surfaces of the unfired multilayer structure using the conductive paste. After that, the unfired multilayer structure is fired to form the multilayer structure, the external shield conductor layers 53A to 53F and the first and second input/output terminals 8A and 8D at the same time. Thus, in the second example, the external shield conductor layers 53A to 53F and the first and second input/output terminals 8A and 8D are formed concurrently with the step of fabricating the multilayer structure.

In the third example, the multilayer structure is formed in the same manner as in the first example, and then the external shield conductor layers 53B, 53C, 53D, 53E and 53F are formed on the surfaces of the multilayer structure using a thin-film formation method. In the third example, the external shield conductor layer 53A and the first and second input/output terminals 8A and 8D are formed currently with the step of fabricating the multilayer structure, and the external shield conductor layers 53B, 53C, 53D, 53E and 53F are formed after the step of fabricating the multilayer structure. Each of the external shield conductor layers 53B, 53C, 53D, 53E and 53F includes a first layer formed by, for example, sputtering or vacuum deposition, and a second layer formed by, for example, plating.

In the first and second examples, the conductive paste to form the external shield conductor layers 53B, 53C, 53D, 53E and 53F has a composition that results in a higher adhesive strength to the surrounding dielectric portion 3, more specifically a composition having a higher ratio of glass component, as compared with the conductive paste to form the first and second internal shield conductor layers 51 and 52. Therefore, the first and second internal shield conductor layers 51 and 52 have a higher conductivity than the first conductivity, which is the conductivity of the external shield conductor layers 53B, 53C, 53D, 53E and 53F.

In the third example, the first layer of each of the external shield conductor layers 53B, 53C, 53D, 53E and 53F is formed of a material that has a lower conductivity and a higher adhesive force to the surrounding dielectric portion 3 than the second layer. As a result, the first layer is lower in conductivity than the second layer and the first and second internal shield conductor layers 51 and 52. The substantial conductivity of each of the external shield conductor layers 53B, 53C, 53D, 53E and 53F is the conductivity of the first layer in contact with the surrounding dielectric portion 3. Therefore, the conductivity of the first and second internal shield conductor layers 51 and 52 is higher than the first conductivity.

In any of the first to third examples, the conductive paste to form the external shield conductor layer 53A preferably has a composition that results in a higher adhesive strength to the surrounding dielectric portion 3, more specifically a composition having a higher ratio of glass component, as compared with the conductive paste to form the first and second internal shield conductor layers 51 and 52. In such a case, the first and second internal shield conductor layers 51 and 52 become higher in conductivity than the external shield conductor layers 53A, 53B, 53C, 53D, 53E and 53F.

The first conductivity is in the range of, for example, $20\times10^6$ S/m to $30\times10^6$ S/m. The second conductivity, which is the conductivity of the first internal shield conductor layer 51, and the conductivity of the second internal shield conductor layer 52 are in the range of, for example, $22\times10^6$ S/m to $50\times10^6$ S/m. The second conductivity and the conductivity of the second internal shield conductor layer 52 are preferably higher than the first conductivity by 30% or more of the first conductivity.

The distance between the first internal shield conductor layer 51 and each of the resonator bodies 2A, 2B, 2C and 2D is smaller than the distance between any one of the external shield conductor layers and any one of the resonator bodies 2. Providing the first internal shield conductor layer 51 in the vicinity of the resonator bodies 2A, 2B, 2C and 2D results in an increase in the value obtained by dividing the resonant frequency of a high-order adjacent resonance mode by the resonant frequency of a resonance mode in the resonators 12A, 12B, 12C and 12D, thus allowing a reduction in the effect of the high-order adjacent resonance mode, relative to the case where the first internal shield conductor layer 51 is not provided.

Likewise, providing the second internal shield conductor layer 52 in the vicinity of the resonator bodies 2B and 2C results in an increase in the value obtained by dividing the resonant frequency of a high-order adjacent resonance mode by the resonant frequency of a resonance mode in the resonators 12B and 12C, thus allowing a reduction in the effect of the high-order adjacent resonance mode, relative to the case where the second internal shield conductor layer 52 is not provided.

To reduce the effect of the high-order adjacent resonance mode, it is conceivable, for example, to bring the external shield conductor layer 53B near the resonator bodies 2A, 2B, 2C, and 2D without providing the first internal shield conductor layer 51. In such a case, however, since the conductivity of the external shield conductor layer 53B is lower than that of the first internal shield conductor layer 51, an increase in conductor loss will result to cause a reduction in Q of the resonators 12A, 12B, 12C and 12D.

In contrast, according to this embodiment, the first internal shield conductor layer 51 having a higher conductivity than that of the external shield conductor layer 53B is disposed near the resonator bodies 2A, 2B, 2C and 2D. This enables a reduction in the effect of the high-order adjacent resonance mode in the resonators 12A, 12B, 12C and 12D, and enables an increase in Q of the resonators 12A, 12B, 12C and 12D.

Likewise, the provision of the second internal shield conductor layer 52 near the resonator bodies 2B and 2C enables a reduction in the effect of the high-order adjacent resonance mode in the resonators 12B and 12C, and enables an increase in Q of the resonators 12B and 12C.

Since the first and second internal shield conductor layers 51 and 52 are located inside the surrounding dielectric portion 3, they are less likely to be deformed than the external shield conductor layers. This enables reducing variations' in characteristics of the resonators 12A, 12B, 12C and 12D and the dielectric filter 1 caused by deformations of the conductor layers, relative to the case of bringing the external shield conductor layers near the resonator bodies 2A, 2B, 2C and 2D.

The results of a third simulation, which indicate the effect of the first internal shield conductor layer 51, will now be described. In the third simulation, resonant frequencies and Qs were compared between an example dielectric resonator, which corresponds to the resonator 12A, and first and second comparative-example dielectric resonators.

For the example dielectric resonator, the conductivity of the external shield conductor layer 53B, i.e., the first conductivity, was set at $22\times10^6$ S/m, and the conductivity of the first internal shield conductor layer 51, i.e., the second conductivity, was set at $40\times10^6$ S/m.

The first comparative-example dielectric resonator is identical with the example dielectric resonator except for not including the first internal shield conductor layer 51.

The second comparative-example dielectric resonator is identical with the example dielectric resonator except that the first internal shield conductor layer 51 is replaced with an internal shield conductor layer having a conductivity equal to that of the external shield conductor layer 53B. The second comparative-example dielectric resonator corresponds to a dielectric resonator having a configuration in which the external shield conductor layer 53B is not provided and the external shield conductor layer 53B is brought near the resonator body 2A. The results of the third simulation are shown in Table 1 below.

TABLE 1

| | Resonant frequency (GHz) | Q |
|---|---|---|
| First comparative example | 29.44 | 1076 |
| Second comparative example | 29.50 | 1031 |

As shown in Table 1, the second comparative example is lower in Q than the first comparative example. This is because the internal shield conductor layer having a conductivity equal to that of the external shield conductor layer 53B is located near the resonator body. For the example, a higher Q was obtained as compared with the first and second comparative examples in spite of the presence of the first internal shield conductor layer 51 near the resonator body. This is the effect of the first internal shield conductor layer 51 having the second conductivity higher than the first conductivity.

The present invention is not limited to the above-described embodiment, and various modifications may be made thereto. For example, the resonator body and the input/output conductor portion may be aligned in a horizontal direction to have the positional relationship defined in claims. In such a case, the resonator body may be constituted of a plurality of layers stacked on top of each other.

Obviously, many modifications and variations of the present invention are possible in the light of the above teachings. Thus, it is to be understood that, within the scope of the appended claims and equivalents thereof, the invention may be practiced in other than the foregoing most preferable embodiment.

What is claimed is:

1. A dielectric filter comprising:

a resonator body formed of a dielectric material;

a surrounding dielectric portion present around the resonator body and formed of a dielectric material having a relative permittivity lower than that of the dielectric material used to form the resonator body; and an input/output conductor portion formed of a conductor and configured to perform at least one of supply of an electromagnetic wave to the resonator body and reception of an electromagnetic wave from the resonator body, wherein a dimension of the resonator body in a first direction is greater than a maximum dimension of the resonator body in a direction orthogonal to the first direction, the resonator body has a first end face and a second end face located at opposite ends in the first direction, and the input/output conductor portion is located such that an entirety of the input/output conductor portion is contained in a space that is formed by shifting a virtual plane corresponding to the first end face in the first direction away from the second end face.

2. The dielectric filter according to claim 1, wherein any cross section of the resonator body that is orthogonal to the first direction has a constant shape irrespective of a distance between the cross section and the first end face.

3. The dielectric filter according claim 1, further comprising a shield conductor portion formed of a conductor, wherein the shield conductor portion is located around the resonator body such that at least part of the surrounding dielectric portion is interposed between at least part of the resonator body and the shield conductor portion.

4. The dielectric filter according to claim 1, wherein the input/output conductor portion has a third end face and a fourth end face located at opposite ends in the first direction, and the third end face is located closer to the first end face of the resonator body than is the fourth end face.

5. The dielectric filter according to claim 4, wherein the input/output conductor portion has a shape having three-fold or higher rotational symmetry about an axis parallel to the first direction.

6. The dielectric filter according to claim 4, wherein the input/output conductor portion is embedded in the surrounding dielectric portion such that the fourth end face is exposed on an external surface of the surrounding dielectric portion.

7. The dielectric filter according to claim 4, wherein a dimension of the input/output conductor portion in the first direction is in a range of 0.2 to 1 times the distance between the first end face and a virtual plane that includes the fourth end face and is parallel to the first end face.

8. The dielectric filter according to claim 4, wherein a dimension of the input/output conductor portion in the first direction is greater than a maximum dimension of the input/output conductor portion in a direction orthogonal to the first direction.

9. A dielectric filter comprising:

a resonator body formed of a dielectric material;

a surrounding dielectric portion present around the resonator body and formed of a dielectric material having a relative permittivity lower than that of the dielectric material used to form the resonator body;

an input/output conductor portion formed of a conductor and configured to perform at least one of supply of an electromagnetic wave to the resonator body and reception of an electromagnetic wave from the resonator body, and a shield conductor portion formed of a conductor, wherein a dimension of the resonator body in a first direction is greater than a maximum dimension of the resonator body in a direction orthogonal to the first direction, the resonator body has a first end face and a second end face located at opposite ends in the first direction, the input/output conductor portion is located either such that at least part of the input/output conductor portion is contained in a space that is formed by shifting a virtual plane corresponding to the first end face in the first direction away from the second end face, or such that the input/output conductor portion is in contact with the space, and the shield conductor portion is located around the resonator body such that at least part of the surrounding dielectric portion is interposed between at least part of the resonator body and the shield conductor portion.

10. A dielectric filter comprising:

a plurality of resonator bodies each formed of a dielectric material;

a surrounding dielectric portion present around the plurality of resonator bodies and formed of a dielectric material having a relative permittivity lower than that of the dielectric material used to form the plurality of resonator bodies; and a first input/output conductor portion and a second input/output conductor portion each formed of a conductor, wherein of the plurality of resonator bodies, every two resonator bodies that are adjacent to each other in circuit configuration are configured to be electromagnetically coupled to each other, the plurality of resonator bodies include a first input/output stage resonator body and a second input/output stage resonator body, the first input/output conductor portion is configured to perform at least one of supply of an electromagnetic wave to the first input/output stage resonator body and reception of an electromagnetic wave from the first input/output stage resonator body, the second input/output conductor portion is configured to perform at least one of supply of an electromagnetic wave to the second input/output stage resonator body and reception of an electromagnetic wave from the second input/output stage resonator body, respective dimensions of the first and second input/output stage resonator bodies in a first direction are greater than respective maximum dimensions of the first and second input/output stage resonator bodies in a direction orthogonal to the first direction, each of the first and second input/output stage resonator bodies has a first end face and a second end face located at opposite ends in the first direction, the first input/output conductor portion is located such that an entirety of the first input/output conductor portion is contained in a first space that is formed by shifting a virtual plane corresponding to the first end face of the first input/output stage resonator body in the first direction away from the second end face of the first input/output stage resonator body, and the second input/output conductor portion is located such that an entirety of the second input/output conductor portion is contained in a second space that is formed by shifting a virtual plane corresponding to the first end face of the second input/output stage resonator body in the first direction away from the second end face of the second input/output stage resonator body.

11. A dielectric filter comprising:

a resonator body formed of a dielectric material;

a surrounding dielectric portion present around the resonator body and formed of a dielectric material having a relative permittivity lower than that of the dielectric material used to form the resonator body; and an input/output conductor portion formed of a conductor and configured to perform at least one of supply of an electromagnetic wave to the resonator body and reception of an electromagnetic wave from the resonator body, wherein a dimension of the resonator body in a first direction is greater than a maximum dimension of the resonator body in a direction orthogonal to the first direction, the resonator body has a first end face and a second end face located at opposite ends in the first direction, the input/output conductor portion is located either such that at least part of the input/output conductor portion is contained in a space that is formed by shifting a virtual plane corresponding to the first end face in the first direction away from the second end face, or such that the input/output conductor portion is in contact with the space, the input/output conductor portion has a third end face and a fourth end face located at opposite ends in the first direction, the third end face is located closer to the first end face of the resonator body than is the fourth end face, and the input/output conductor portion has a shape having three-fold or higher rotational symmetry about an axis parallel to the first direction.

12. A dielectric filter comprising:

a resonator body formed of a dielectric material;

a surrounding dielectric portion present around the resonator body and formed of a dielectric material having a relative permittivity lower than that of the dielectric material used to form the resonator body; and an input/output conductor portion formed of a conductor and configured to perform at least one of supply of an electromagnetic wave to the resonator body and reception of an electromagnetic wave from the resonator body, wherein a dimension of the resonator body in a first direction is greater than a maximum dimension of the resonator body in a direction orthogonal to the first direction, the resonator body has a first end face and a second end face located at opposite ends in the first direction, the input/output conductor portion is located either such that at least part of the input/output conductor portion is contained in a space that is formed by shifting a virtual plane corresponding to the first end face in the first direction away from the second end face, or such that the input/output conductor portion is in contact with the space, the input/output conductor portion has a third end face and a fourth end face located at opposite ends in the first direction, the third end face is located closer to the first end face of the resonator body than is the fourth end face, and the input/output conductor portion is embedded in the surrounding dielectric portion such that the fourth end face is exposed on an external surface of the surrounding dielectric portion.

13. A dielectric filter comprising:

a resonator body formed of a dielectric material;

a surrounding dielectric portion present around the resonator body and formed of a dielectric material having a relative permittivity lower than that of the dielectric material used to form the resonator body; and an input/output conductor portion formed of a conductor and configured to perform at least one of supply of an electromagnetic wave to the resonator body and reception of an electromagnetic wave from the resonator body, wherein a dimension of the resonator body in a first direction is greater than a maximum dimension of the resonator body in a direction orthogonal to the first direction, the resonator body has a first end face and a second end face located at opposite ends in the first direction, the input/output conductor portion is located either such that at least part of the input/output conductor portion is contained in a space that is formed by shifting a virtual plane corresponding to the first end face in the first direction away from the second end face, or such that the input/output conductor portion is in contact with the space, the input/output conductor portion has a third end face and a fourth end face located at opposite ends in the first direction, the third end face is located closer to the first end face of the resonator body than is the fourth end face, and a dimension of the input/output conductor portion in the first direction is in a range of 0.2 to 1 times the distance between the first end face and a virtual plane that includes the fourth end face and is parallel to the first end face.

14. A dielectric filter comprising:

a resonator body formed of a dielectric material;

a surrounding dielectric portion present around the resonator body and formed of a dielectric material having a relative permittivity lower than that of the dielectric material used to form the resonator body; and an input/output conductor portion formed of a conductor and configured to perform at least one of supply of an electromagnetic wave to the resonator body and reception of an electromagnetic wave from the resonator body, wherein a dimension of the resonator body in a first direction is greater than a maximum dimension of the resonator body in a direction orthogonal to the first direction, the resonator body has a first end face and a second end face located at opposite ends in the first direction, the input/output conductor portion is located either such that at least part of the input/output conductor portion is contained in a space that is formed by shifting a virtual plane corresponding to the first end face in the first direction away from the second end face, or such that the input/output conductor portion is in contact with the space, the input/output conductor portion has a third end face and a fourth end face located at opposite ends in the first direction, the third end face is located closer to the first end face of the resonator body than is the fourth end face, and a dimension of the input/output conductor portion in the first direction is greater than a maximum dimension of the input/output conductor portion in a direction orthogonal to the first direction.

* * * * *